US012365023B2

(12) United States Patent
Ishii et al.

(10) Patent No.: US 12,365,023 B2
(45) Date of Patent: Jul. 22, 2025

(54) GREEN SAND MOLD FORMING SENSOR AND GREEN SAND MOLD FORMABILITY EVALUATION METHOD

(71) Applicant: SINTOKOGIO, LTD., Nagoya (JP)

(72) Inventors: Takato Ishii, Toyokawa (JP); Yasuaki Asaoka, Toyokawa (JP); Hisashi Harada, Toyokawa (JP); Takehiro Sugino, Toyokawa (JP)

(73) Assignee: SINTOKOGIO, LTD., Nagoya (JP)

( * ) Notice: Subject to any disclaimer, the term of this patent is extended or adjusted under 35 U.S.C. 154(b) by 0 days.

(21) Appl. No.: 17/471,938

(22) Filed: Sep. 10, 2021

(65) Prior Publication Data

US 2021/0402462 A1 Dec. 30, 2021

Related U.S. Application Data

(62) Division of application No. 16/962,536, filed as application No. PCT/JP2019/017576 on Apr. 25, 2019, now abandoned.

(30) Foreign Application Priority Data

May 7, 2018 (JP) ..... 2018-089064

(51) Int. Cl.

| | |
|---|---|
| ***B22C 11/10*** | (2006.01) |
| ***B22C 7/04*** | (2006.01) |
| ***B22C 9/02*** | (2006.01) |
| ***B22C 19/04*** | (2006.01) |

(52) U.S. Cl.

CPC ..... *B22C 19/04* (2013.01); *B22C 7/04* (2013.01); *B22C 9/02* (2013.01); *B22C 11/10* (2013.01)

(58) Field of Classification Search

CPC ..... B22C 11/10; B22C 7/04

See application file for complete search history.

(56) References Cited

U.S. PATENT DOCUMENTS 134,663 A * 1/1873 Harper ..... B22C 7/04 164/243

2,448,827 A * 9/1948 Reder, Jr. ..... B22C 7/04 164/241

(Continued)

FOREIGN PATENT DOCUMENTS

CN 1349941 A 5/2002

CN 101868310 A 10/2010

(Continued)

OTHER PUBLICATIONS

Jul. 30, 2019 International Search Report issued in International Patent Application No. PCT/JP2019/017600.

(Continued)

*Primary Examiner* — Kevin E Yoon

(74) *Attorney, Agent, or Firm* — Oliff PLC

(57) ABSTRACT

A green sand mold molding sensor that can measure the pressure applied to a parting plane of a green sand mold in order to determine the quality (casting mold strength) of a molded green sand mold. A green sand mold molding sensor including a pressure sensor for evaluating the molding properties of a green sand mold molded by a casting mold molding machine, wherein the pressure sensor is embedded in a plate having a model attached thereto.

9 Claims, 15 Drawing Sheets

(56) References Cited

U.S. PATENT DOCUMENTS

| | | | | | |
|---|---|---|---|---|---|
| 2,863,193 | A * | 12/1958 | Le Baron, Jr. | B22C 9/03 | 164/241 |
| 3,004,311 | A * | 10/1961 | Snoeyenbos | B22C 7/04 | 164/13 |
| 3,302,255 | A * | 2/1967 | Wagner, Jr. | B22C 7/00 | 164/238 |
| 3,933,194 | A * | 1/1976 | Hijikata | B22C 7/04 | 164/160.2 |
| 4,878,534 | A | 11/1989 | Weimann | | |
| 5,558,148 | A | 9/1996 | Uzaki et al. | | |
| 6,390,178 | B1 | 5/2002 | Makino | | |
| 6,470,953 | B1 | 10/2002 | Hirata et al. | | |
| 6,499,531 | B1 * | 12/2002 | Knudsen | B22C 11/10 | 164/211 |
| 6,957,687 | B2 | 10/2005 | Hirata et al. | | |
| 7,191,818 | B2 | 3/2007 | Hirata et al. | | |
| 7,341,095 | B2 | 3/2008 | Hirata et al. | | |
| 8,347,946 | B2 | 1/2013 | Hadano et al. | | |
| 8,616,263 | B2 | 12/2013 | Hadano et al. | | |
| 9,086,236 | B2 | 7/2015 | Hirata | | |
| 2002/0129917 | A1 | 9/2002 | Kaneto et al. | | |
| 2002/0157802 | A1 | 10/2002 | Amano et al. | | |
| 2004/0129404 | A1 | 7/2004 | Amano et al. | | |
| 2004/0206472 | A1 | 10/2004 | Hirata et al. | | |
| 2005/0279482 | A1 | 12/2005 | Hirata et al. | | |
| 2005/0279483 | A1 | 12/2005 | Hirata et al. | | |
| 2006/0037730 | A1 | 2/2006 | Hirata et al. | | |
| 2006/0037731 | A1 | 2/2006 | Hirata et al. | | |
| 2008/0093044 | A1 | 4/2008 | Hirata et al. | | |
| 2010/0276528 | A1 | 11/2010 | Aoki et al. | | |
| 2015/0144289 | A1 | 5/2015 | Kato et al. | | |
| 2015/0197044 | A1 | 7/2015 | Kato et al. | | |
| 2018/0133719 | A1 | 5/2018 | Oba et al. | | |
| 2019/0193144 | A1 | 6/2019 | Iburg | | |

FOREIGN PATENT DOCUMENTS

| | | | |
|---|---|---|---|
| CN | 104334296 | A | 2/2015 |
| CN | 205393449 | U | 7/2016 |
| CN | 206194914 | U | 5/2017 |
| CN | 107297470 | A | 10/2017 |
| CN | 107321933 | A | 11/2017 |
| CN | 107635693 | A | 1/2018 |
| DE | 202113 | A5 * | 2/1982 |
| EP | 0122116 | A2 * | 10/1984 |
| EP | 1433548 | A1 | 6/2004 |
| EP | 2604362 | A2 | 6/2013 |
| JP | S49-037888 | B1 | 10/1974 |
| JP | S60-115346 | A | 6/1985 |
| JP | S61-092439 | U | 6/1986 |
| JP | S62-174247 | U | 11/1987 |
| JP | H01-289536 | A | 11/1989 |
| JP | H04-158949 | A | 6/1992 |
| JP | H07-232235 | A | 9/1995 |
| JP | 2000-117394 | A | 4/2000 |
| JP | 2001-038451 | A | 2/2001 |
| JP | 2001-198651 | A | 7/2001 |
| JP | 2001-293540 | A | 10/2001 |
| JP | 2002-028754 | A | 1/2002 |
| JP | 2002-263793 | A | 9/2002 |
| JP | 3415497 | B2 | 6/2003 |
| JP | 3729197 | B2 | 12/2005 |
| WO | 03/013762 | A1 | 2/2003 |
| WO | 2011/070814 | A1 | 6/2011 |
| WO | 2016/103992 | A1 | 6/2016 |
| WO | 2016/203394 | A1 | 12/2016 |
| WO | 2017077373 | A1 | 5/2017 |

OTHER PUBLICATIONS

Jun. 4, 2019 International Search Report issued in International Patent Application No. PCT/JP2019/017577.
Jul. 30, 2019 International Search Report issued in International Patent Application No. PCT/JP2019/017598.
Jul. 30, 2019 International Search Report issued in International Patent Application No. PCT/JP2019/017599.
Jun. 4, 2019 International Search Report issued in International Patent Application No. PCT/JP2019/017576.
U.S. Appl. No. 16/965,213, filed Jul. 27, 2020 in the name of Ishii et al.
U.S. Appl. No. 17/050,126, filed Oct. 23, 2020 in the name of Takasu et al.
U.S. Appl. No. 17/046,144, filed Oct. 8, 2020 in the name of Ishii et al.
U.S. Appl. No. 17/042,231, filed Sep. 28, 2020 in the name of Ishii et al.
U.S. Appl. No. 16/962,536, filed Jul. 16, 2020 in the name of Ishii et al.
Apr. 13, 2021 Office Action issued in U.S. Appl. No. 16/965,213.
May 26, 2021 Office Action issued in U.S. Appl. No. 17/042,231.
Jul. 23, 2021 Office Action issued in U.S. Appl. No. 16/965,213.
Jul. 23, 2021 Office Action issued in U.S. Appl. No. 17/046,144.
Sep. 9, 2021, Notice of Non-Compliant Amendment issued in U.S. Appl. No. 17/042,231.
Jul. 12, 2021 Notice of Non-Responsive Amendment issued in U.S. Appl. No. 16/962,536.
Mar. 22, 2021 Office Action issued in U.S. Appl. No. 16/962,536.
U.S. Appl. No. 17/518,114, filed Nov. 3, 2021 in the name of Ishii et al.
Nov. 9, 2021 Office Action issued in U.S. Appl. No. 17/046,144.
U.S. Appl. No. 17/046,126, filed Oct. 8, 2020 in the name of Ishii et al.
Sep. 9, 2021, Notice of Allowance Issued in U.S. Appl. No. 16/637,415.
Sep. 28, 2021 Office Action issued in U.S. Appl. No. 17/050,126.
Apr. 28, 2022 Office Action issued in U.S. Appl. No. 17/050,126.
Sep. 9, 2022 Office Action issued in U.S. Appl. No. 17/518,114.
Dec. 20, 2022 Office Action issued in U.S. Appl. No. 17/518,114.
Apr. 6, 2023 Office Action issued in U.S. Appl. No. 17/518,114.
Jul. 27, 2023 Office Action issued in U.S. Appl. No. 17/518,114.
Oct. 17, 2023 Advisory Action issued in U.S. Appl. No. 17/518,114.

* cited by examiner

| No. | PEAK PRESSURE A (MPa) | PEAK PRESSURE B (MPa) | CASTING MOLD STRENGTH A ($N/cm^2$) | CASTING MOLD STRENGTH B ($N/cm^2$) |
|---|---|---|---|---|
| 1 | 0.292 | 0.362 | INPUT VALUE | INPUT VALUE |
| 2 | 0.430 | 0.199 | INPUT VALUE | INPUT VALUE |
| 3 | 0.500 | 0.417 | INPUT VALUE | INPUT VALUE |
| 4 | 0.375 | 0.130 | INPUT VALUE | INPUT VALUE |
| 5 | 0.591 | 0.202 | INPUT VALUE | INPUT VALUE |
| 6 | 0.511 | 0.394 | INPUT VALUE | INPUT VALUE |
| 7 | 0.503 | 0.232 | INPUT VALUE | INPUT VALUE |

| | |
|---|---|
| SLOPE | a |
| INTERCEPT | b |

FIG. 11

| | LOWER LIMIT | UPPER LIMIT |
|---|---|---|
| SENSOR A STRENGTH NORMAL RANGE ($N/cm^2$) | 10. 0 | 20. 0 |
| SENSOR B STRENGTH NORMAL RANGE ($N/cm^2$) | 10. 0 | 20. 0 |
| SENSOR C STRENGTH NORMAL RANGE ($N/cm^2$) | 10. 0 | 20. 0 |
| SENSOR D STRENGTH NORMAL RANGE ($N/cm^2$) | 10. 0 | 20. 0 |
| CASTING MOLD STRENGTH DIFFERENCE (MAX. − MIN.) ABNORMALITY VALUE ($N/cm^2$) | 5. 0 | |

FIG. 12

| No. | PEAK PRESSURE A (MPa) | PEAK PRESSURE B (MPa) | PEAK PRESSURE C (MPa) | PEAK PRESSURE D (MPa) | CASTING MOLD STRENGTH A ($N/cm^2$) | CASTING MOLD STRENGTH B ($N/cm^2$) | CASTING MOLD STRENGTH C ($N/cm^2$) | CASTING MOLD STRENGTH D ($N/cm^2$) | CASTING MOLD STRENGTH DIFFERENCE MAX. - MIN. ($N/cm^2$) | DETERMINATION |
|---|---|---|---|---|---|---|---|---|---|---|
| 1 | 0.453 | 0.301 | 0.444 | 0.331 | 17.2 | 12.7 | 16.9 | 13.6 | 4.5 | OK |
| 2 | 0.584 | 0.377 | 0.468 | 0.364 | 21.1 | 15.0 | 17.7 | 14.6 | 6.5 | F.T |
| 3 | 0.523 | 0.346 | 0.458 | 0.388 | 19.3 | 14.0 | 17.4 | 15.3 | 5.3 | F.T |
| 4 | 0.454 | 0.333 | 0.433 | 0.384 | 17.2 | 13.6 | 16.6 | 15.2 | 3.6 | OK |
| 5 | 0.528 | 0.426 | 0.435 | 0.390 | 19.4 | 16.4 | 16.7 | 15.3 | 4.1 | OK |
| 6 | 0.387 | 0.256 | 0.386 | 0.321 | 15.2 | 11.3 | 15.2 | 13.3 | 3.9 | OK |
| 7 | 0.353 | 0.200 | 0.358 | 0.349 | 14.2 | 9.7 | 14.4 | 14.1 | 4.7 | F.T |

GREEN SAND MOLD FORMING SENSOR AND GREEN SAND MOLD FORMABILITY EVALUATION METHOD

TECHNICAL FIELD

The present invention is related to a green sand mold molding sensor that evaluates the moldability of a green sand mold molded by a casting mold molding machine.

BACKGROUND

One of the qualities demanded of a green sand mold (casting mold) molded by a casting mold molding device is casting mold strength. Normally, in order to determine whether a molded green sand mold has sufficient casting mold strength, work is carried out to measure each molded green sand mold individually using a casting mold strength gauge. A method for confirming whether a molded green sand mold has sufficient casting mold strength without having to perform such work is desired. Furthermore, a method for managing the casting mold quality of each molded green sand mold without stopping a process is desired.

For example, Patent Document 1 discloses a method for detecting abnormalities in blowing in and filling of casting sand in a blow-in type casting mold molding machine, wherein an internal pressure is measured by a pressure sensor in order to detect abnormalities in blowing in and filling of casting sand.

Further, Patent Document 2 discloses a molding device monitoring system which discovers defective casting molds by using position sensors for measuring positions of frame-setting cylinders, filling-frame cylinders, and a leveling frame to monitor the height of a parting plane of a casting mold.

CITATION LIST

Patent Literature

Patent Document 1: JP 3415497 B
Patent Document 2: JP 3729197 B

SUMMARY OF INVENTION

Technical Problem

However, the method for detecting abnormalities in blowing in and filling of casting sand of Patent Document 1 is capable of detecting sand filling defects only and it is difficult to confirm the precise casting mold strength. Further, even if the molding device monitoring system of Patent Document 2 monitors the height of the parting plane of the casting mold, it is difficult to confirm the precise casting mold strength from the height of the parting plane.

The present invention was achieved in light of the foregoing and has the objective of providing a green sand mold molding sensor that can measure pressure applied to a parting plane of a green sand mold in order to determine the quality (casting mold strength) of a molded green sand mold.

Solution to Problem

In order to solve the problem mentioned above and achieve the objective, the green sand mold molding sensor of the present invention comprises a pressure sensor for evaluating the moldability of a green sand mold molded by a casting mold molding machine, wherein the pressure sensor is embedded in a plate having a model attached thereto.

Further, in one embodiment of the present invention, the plate having the model attached thereto is a member that constitutes a part of a boundary of a molding space defined by the plate and a metal flask during green sand mold molding by the casting mold molding machine.

Further, in one embodiment of the present invention, a pressure-receiving surface of the pressure sensor and a surface of the plate are in a flush state.

Further, in one embodiment of the present invention, the pressure sensor is embedded between the wall of the metal flask and the model in the plate at the time of green sand mold molding.

Further, in one embodiment of the present invention, the plate is configured to be rectangular, a plurality of the pressure sensors are provided, and these pressure sensors are embedded in the four corners of the plate.

Further, in one embodiment of the present invention, the plate having the model attached thereto is divided into a central part having the model attached thereto and a peripheral part having the pressure sensor embedded therein, and the central part of the plate having the model attached thereto is configured so as to be attachable and detachable.

Further, in one embodiment of the present invention, the casting mold molding machine is a flask molding machine and the plate is placed on a carrier.

Further, in one embodiment of the present invention, the casting mold molding machine is a flaskless molding machine and the model is attached to both surfaces of the plate.

Further, in one embodiment of the present invention, the casting mold molding machine is a flaskless molding machine and the plate is placed on a shuttle dolly.

Further, in one embodiment of the present invention, the pressure sensor is fixed to the plate by a screwing means.

Further, in one embodiment of the present invention, the pressure sensor is a fluid sensor.

Further, in one embodiment of the present invention, the size of the pressure-receiving surface of the pressure sensor is 5-30 mm in diameter.

Further, a method for evaluating green sand mold moldability in the present invention evaluates moldability of a green sand mold molded by a casting mold molding machine by using a green sand mold molding sensor provided with a pressure sensor embedded in a plate having a model attached thereto.

Effects of Invention

According to the present invention, an effect is exhibited wherein it is possible to measure the pressure applied to a parting plane of a green sand mold in order to determine the quality (casting mold strength) of a molded green sand mold.

BRIEF DESCRIPTION OF DRAWINGS

FIG. 11 shows one example of a screen displayed on a display unit.

FIG. 12 shows one example of a screen displayed on a display unit.

DESCRIPTION OF EMBODIMENTS

Hereinafter, reference is made to the attached drawings to describe embodiments for implementing the green sand mold molding sensor and the method for evaluating green sand mold moldability according to the present invention.

First Embodiment

Figure 1:
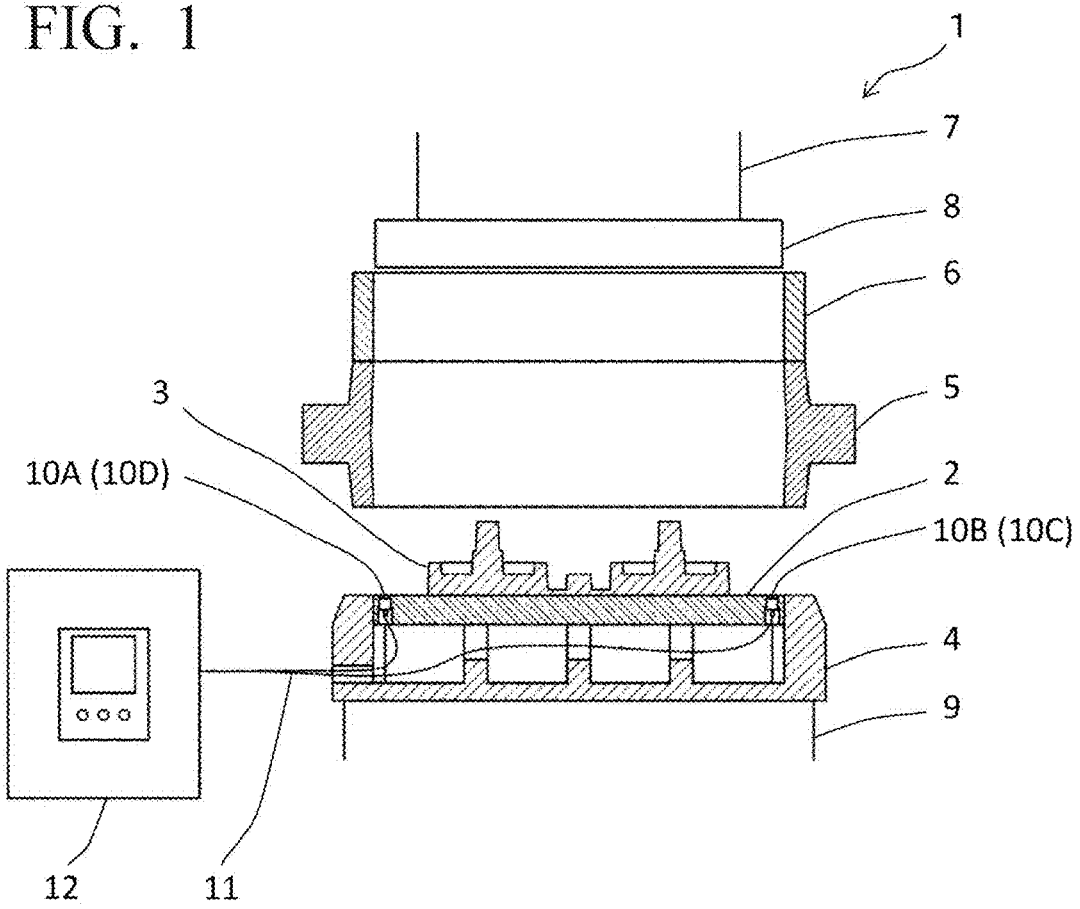
FIG. 1 represents a schematic of a structure of a casting mold molding device using green sand mold molding sensors according to a first embodiment.
Figure 2:
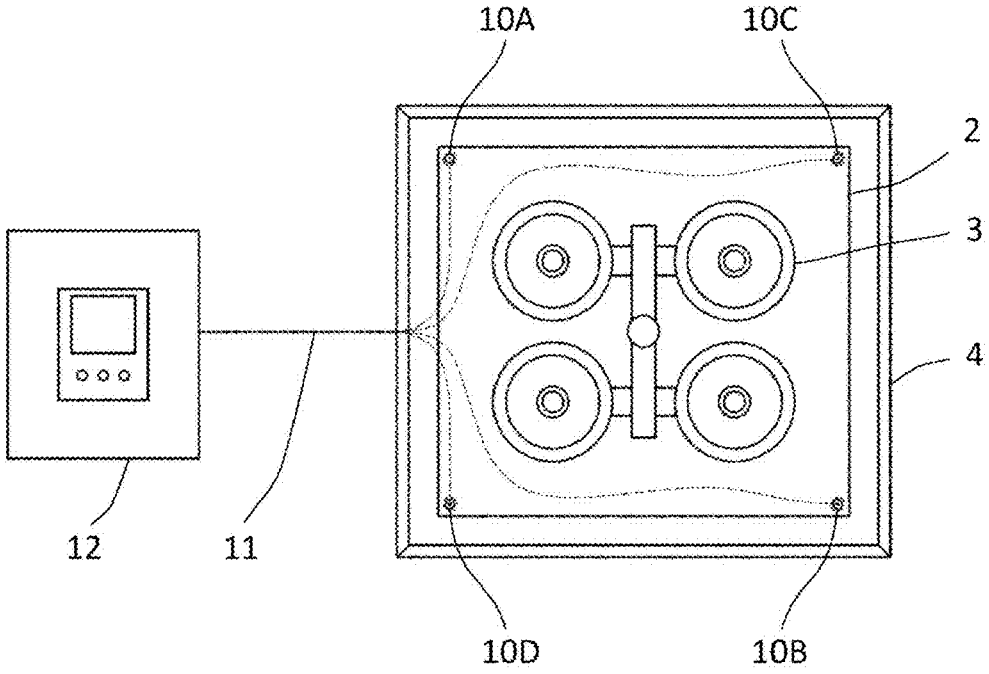
FIG. 2 represents a configuration of a portion of a casting mold molding device, wherein the portion evaluates casting mold quality.

The first embodiment will be described with reference to the attached drawings. FIG. 1 represents a schematic of a structure of a casting mold molding device using green sand mold molding sensors according to the first embodiment and FIG. 2 represents a configuration of a portion of the casting mold molding device, wherein the portion evaluates casting mold quality. The casting mold molding device according to the present embodiment is a flask molding machine in which, after a green sand mold (casting mold) is molded, a casting frame (metal frame), with the green sand mold contained therein, transfers to the next step.

A casting mold molding device 1 comprises a plate 2 having a model 3 attached to an upper surface thereof, a carrier 4, a metal frame 5, a filling frame 6, a squeeze head 7, a squeeze board 8, a table 9, green sand mold molding sensors 10A, 10B, 10C, 10D, wiring 11, and a casting mold quality evaluation device 12. Note that FIG. 2 represents the plate 2, the model 3, the carrier 4, and the green sand mold molding sensors 10A, 10B, 10C, 10D as seen when viewed from the upper side of the casting mold molding device 1.

The plate 2 has attached to an upper surface thereof an upper mold (or lower mold) model 3 for molding a shape of a casting in a green sand mold and is rectangular. The plate 2 is formed from aluminum, for example. The carrier 4 is frame shaped and the plate 2 is placed inside the frame. In addition, green sand for molding a green sand mold is filled into a casting mold molding space surrounded by the plate 2, the metal frame 5, the filling frame 6, and the squeeze board 8. The plate 2 is a member that constitutes a part of a boundary of the molding space defined by the metal frame 5 during green sand mold molding by the casting mold molding device 1.

For the filling of green sand by the casting mold molding device 1, a gravity drop method that uses the weight of the green sand or a blowing method that uses an airflow is employed. The gravity drop method is a method for filling green sand into the casting mold molding space by causing green sand accumulated in a louvered hopper (not shown) disposed at an upper portion of the casting mold molding device 1 to drop due to gravity. Further, the blowing method is a method for filling green sand by blowing green sand inside a sand tank (not shown) into the casting mold molding space.

Here, there follows a brief description of a procedure for loading green sand into the casting mold molding space and compressing. First, the metal frame 5 is placed on top of the carrier 4 and then the filling frame 6 is overlaid on top of the metal frame 5 to define the casting mold molding space. Next, green sand is loaded into the casting mold molding space and the squeeze board 8 compresses (squeezes) the green sand. Due thereto, the green sand in the casting mold molding space is tamped and a green sand mold is molded.

(Green Sand Mold Molding Sensor)

The green sand mold molding sensors 10A, 10B, 10C, 10D measure, during molding of a green sand mold, a pressure value (peak pressure) applied to a parting plane which is a joining section between the plate 2 and an upper mold (or a lower mold) comprising green sand formed inside the casting mold molding space. The green sand mold molding sensors 10A, 10B, 10C, 10D are pressure sensors. In the present embodiment, the green sand mold molding sensors 10A, 10B, 10C, 10D are embedded in the four corners of the plate 2. The reason, which is described later, that the green sand mold molding sensors 10A, 10B, 10C, 10D are embedded in such a way is a result of considering the variation in pressure applied within a plate. By embedding the green sand mold molding sensors 10A, 10B, 10C, 10D in the four corners of the plate 2, it is possible to see the strength distribution of the entire casting mold.

In addition, the green sand mold molding sensors 10A, 10B, 10C, 10D have a pressure-receiving surface for measuring pressure that is exposed in the upper surface of the plate 2 and measures the pressure value (peak pressure) applied to the parting plane with the green sand mold. At this time, it is desirable for the pressure-receiving surface of the green sand mold molding sensors 10A, 10B, 10C, 10D and the upper surface of the plate 2 to be in a flush state with no differences in level therebetween. Due thereto, it is possible to measure the precise pressure. In one example, the green sand mold molding sensors 10A, 10B, 10C, 10D are fluid pressure sensors. An earth pressure sensor may also be used as the green sand mold molding sensors 10A, 10B, 10C, 10D.

Further, regarding the green sand mold molding sensors 10A, 10B, 10C, 10D, a small pressure-receiving surface is desirable, considering the size of the plate 2 in which the sensors are embedded and the size of the model 3, and moreover, that, as described later, the casting mold strength of a green sand mold is measured by a casting mold strength gauge at a position where the green sand mold molding sensors 10A, 10B, 10C, 10D measure a pressure and that a relationship between the pressure value (peak pressure) and the casting mold strength is utilized. Meanwhile, since measurement accuracy is also demanded, with respect to the size of the pressure-receiving surface, a diameter of approximately 5-30 mm is desirable.

Figure 3:
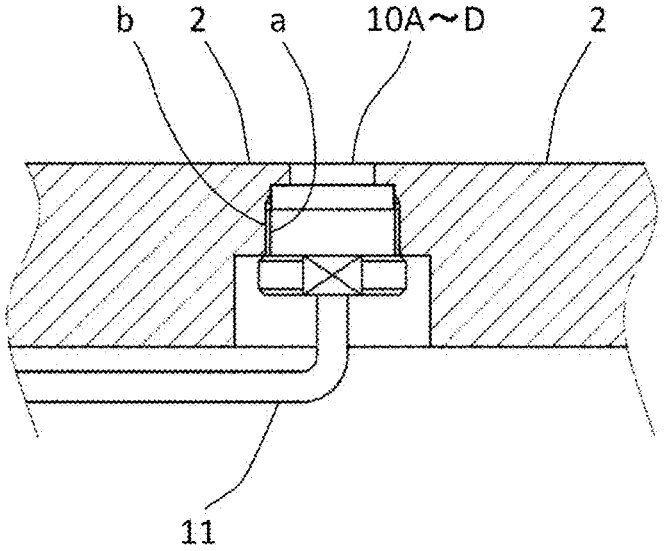
FIG. 3 is a cross-section view representing details of a portion of a plate having green sand mold molding sensors embedded therein.
Figure 4:
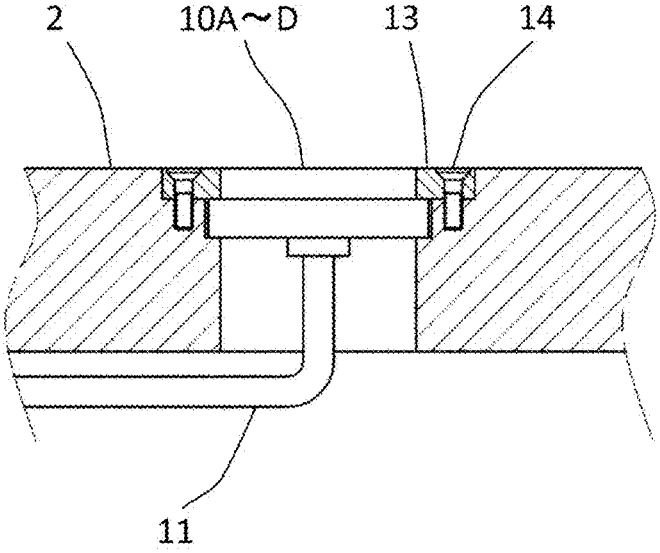
FIG. 4 is a cross-section view representing details of a portion of a plate having green sand mold molding sensors embedded therein.

FIG. 3 and FIG. 4 are lateral cross-section views representing details of a portion of the plate 2 that has green sand mold molding sensors 10A, 10B, 10C, 10D embedded therein. FIG. 3 represents a case wherein the green sand mold molding sensors 10A, 10B, 10C, 10D are of a threaded type. As shown in FIG. 3, a male thread is formed in a of the green sand mold molding sensors 10A, 10B, 10C, 10D, a female thread is formed in b of the plate 2, and the green sand mold molding sensors 10A, 10B, 10C, 10D are screwed to the plate 2.

Meanwhile, FIG. 4 represents a case wherein the green sand mold molding sensors 10A, 10B, 10C, 10D are of a disk shape. As shown in FIG. 4, the green sand mold molding sensors 10A, 10B, 10C, 10D, are placed in a hole in the plate 2 and a ring-shaped liner 13 surrounds the outer edge of the green sand mold molding sensors 10A, 10B, 10C, 10D. In addition, bolts 14 fix the liner 13 and retain the green sand mold molding sensors 10A, 10B, 10C, 10D.

Thus, for the green sand mold molding sensors 10A, 10B, 10C, 10D, it is possible to use an object having a specification of either a threaded type or a disk shape and that selection may be made with consideration be given to an embedding space and attachability of the green sand mold molding sensors.

The wiring 11 connects the casting mold quality evaluation device 12 to the green sand mold molding sensors 10A, 10B, 10C, 10D. In the present embodiment, the green sand mold molding sensors 10A, 10B, 10C, 10D and the casting mold quality evaluation device 12 are connected by wire (wired communication) via the wiring 11 but may also be connected wirelessly (wireless communication). For example, it is possible to amplify, by means of an amplifier, for example, the pressure value (pressure value data) detected by the green sand mold molding sensors 10A, 10B, 10C, 10D and use wireless communication such as a wireless LAN or Bluetooth®, etc., to transmit from a transmitter to the casting mold quality evaluation device 12.

(Casting Mold Quality Evaluation Device)

Figure 5:
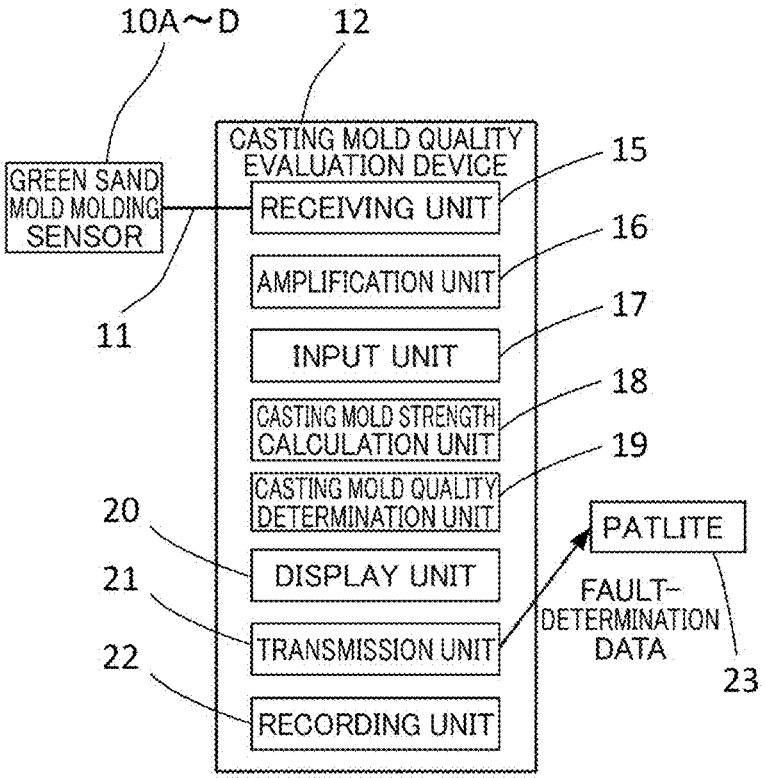
FIG. 5 is a block diagram representing one example of a functional configuration of a casting mold quality evaluation device.

The casting mold quality evaluation device 12 evaluates the quality of a green sand mold molded by the casting mold molding device 1 from the pressure value (pressure value data) measured by the green sand mold molding sensors 10A, 10B, 10C, 10D. FIG. 5 is a block diagram representing a functional configuration of the casting mold quality evaluation device 12 for wired communication data. The casting mold quality evaluation device 12 comprises a receiving unit 15, an amplification unit 16, an input unit 17, a casting mold strength calculation unit 18, a casting mold quality determination unit 19, a display unit 20, a transmission unit 21, and a recording unit 22.

The receiving unit 15 receives the pressure value (pressure value data) measured by the green sand mold molding sensors 10A, 10B, 10C, 10D. In the present example, wired data is received from the wiring 11.

The amplification unit 16 amplifies the signal amount of the received pressure value (pressure value data). The amplification unit 16 is, for example, an amplifier.

The input unit 17 inputs: the casting mold strength of a molded green sand mold measured by a casting mold strength gauge; values of a slope "a" and an intercept "b" in an expression y=ax+b described later; and a threshold value of the casting mold strength of a green sand mold to be molded. Note that inputting is carried out by a worker. The input unit 17 is, for example, a keyboard or a touch panel. In the expression y=ax+b, "y" is the casting mold strength and "x" is the pressure value measured by the green sand mold molding sensors 10A, 10B, 10C, 10D. The expression is a relational expression for determining the casting mold strength "y" from the slope "a" and the intercept "b" which were inputted and a measured value "x".

From the slope "a" and the intercept "b", which were inputted into the input unit 17, and from the pressure value (peak pressure) measured by the green sand mold molding sensors 10A, 10B, 10C, 10D, the casting mold strength calculation unit 18 calculates the casting mold strength for each pressure value (peak pressure) measured by the green sand mold molding sensors 10A, 10B, 10C, 10D by using the relational expression between the measured value and the casting mold strength. A method for calculating the casting mold strength is described in detail later. The casting mold strength calculation unit 18 is, for example, a computer or a PLC.

The casting mold quality determination unit 19 determines the quality of a molded green sand mold from the threshold value of the casting mold strength inputted into the input unit 17 and the calculated casting mold strength. A method for determining the casting mold quality is described in detail later. The casting mold quality determination unit 19 is, for example, a computer or a PLC.

The display unit 20 displays: the pressure value (peak pressure) measured by the green sand mold molding sensors 10A, 10B, 10C, 10D; values of the slope "a" and the intercept "b" in the relational expression y=ax+b between the casting mold strength inputted by a worker using the input unit 17 and the pressure value (peak pressure); the threshold value of the casting mold strength of a green sand mold to be molded that was inputted by a the worker; a casting mold strength calculation result; and a casting mold quality determination result, etc. The display unit 20 is, for example, a liquid crystal display, etc.

The transmission unit 21 transmits fault-determination data to a Patlite® 23, etc. Transmission may be either by wired data or wireless data. In addition, a worker that has recognized a defect occurrence in a green sand mold by confirming that the Patlite 23 is flashing, etc., is to make an X mark on the relevant green sand mold and thereby make it possible to understand at a glance that that green sand mold is a defective product. A green sand mold that has been recognized as being a defective product does not undergo subsequent steps (molten metal pouring) and after skipping these steps is finally shaken out from the mold.

The recording unit 22 records pressure value data, casting mold strength data associated with pressure values, casting mold strength calculation results, and casting mold quality determination results, etc. Furthermore, these data are recorded for each model attached to the plate 2. The recording unit 22 is, for example, a recording medium such as a semiconductor memory or a magnetic disk, etc. In addition, the data recorded by the recording unit 22 may be extracted by using a USB memory or an SD card, etc.

Figure 6:
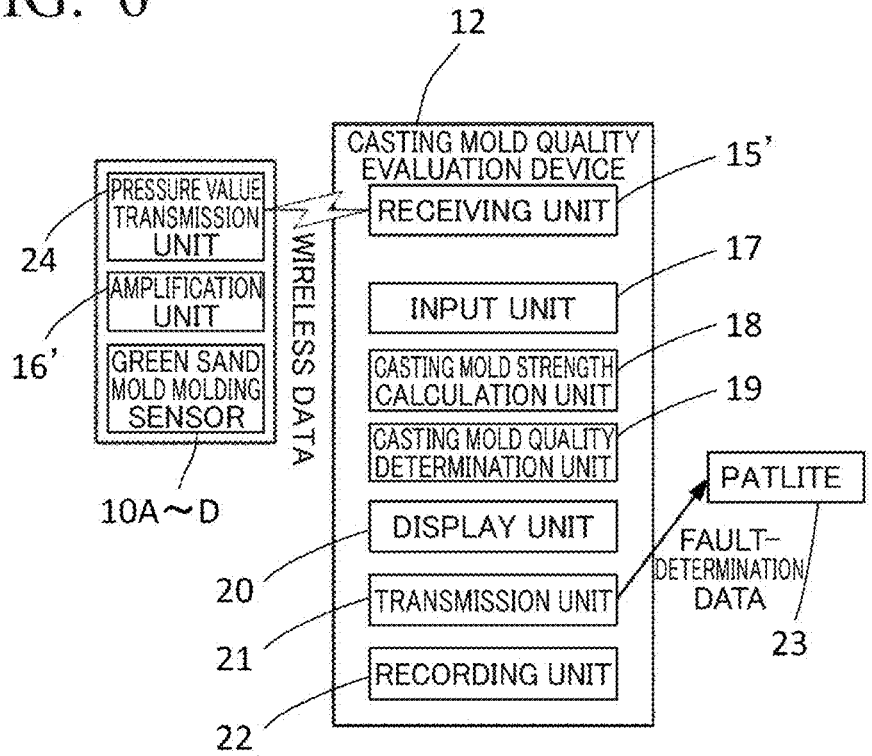
FIG. 6 is a block diagram representing another example of a functional configuration of a casting mold quality evaluation device.

As described earlier, the green sand mold molding sensors 10A, 10B, 10C, 10D and the casting mold quality evaluation device 12 may be connected wirelessly (wireless communication). FIG. 6 is a block diagram representing a functional configuration in the case wherein the pressure value (pressure value data) measured by the green sand mold molding sensors 10A, 10B, 10C, 10D is connected wirelessly (wireless communication) to the casting mold quality evaluation device 12. The pressure value (pressure value data) measured by the green sand mold molding sensors 10A, 10B, 10C, 10D is amplified by an amplification unit 16' near the green sand mold molding sensors and wirelessly transmitted from a pressure value transmission unit 24 to a receiving unit 15' of the casting mold quality evaluation device 12. The casting mold quality evaluation device 12 for wireless data shown in FIG. 6 comprises a receiving unit 15', the input unit 17, the casting mold strength calculation unit 18, the casting mold quality determination unit 19, the display unit 20, the transmission unit 21, and the recording unit 22.

After the pressure value (pressure value data) measured by the green sand mold molding sensors 10A, 10B, 10C, 10D has been amplified by the amplification unit 16', the receiving unit 15' receives wireless data transmitted from the pressure value transmission unit 24. Note that the functions of the input unit 17, the casting mold strength calculation unit 18, the casting mold quality determination unit 19, the display unit 20, the transmission unit 21, and the recording unit 22 are the same as the functions of the casting mold quality evaluation device 12 for wired data described earlier.

(Relationship Between Pressure Measured by Green Sand Mold Molding Sensors and Casting Mold Strength of Molded Green Sand Mold)

Figure 7:
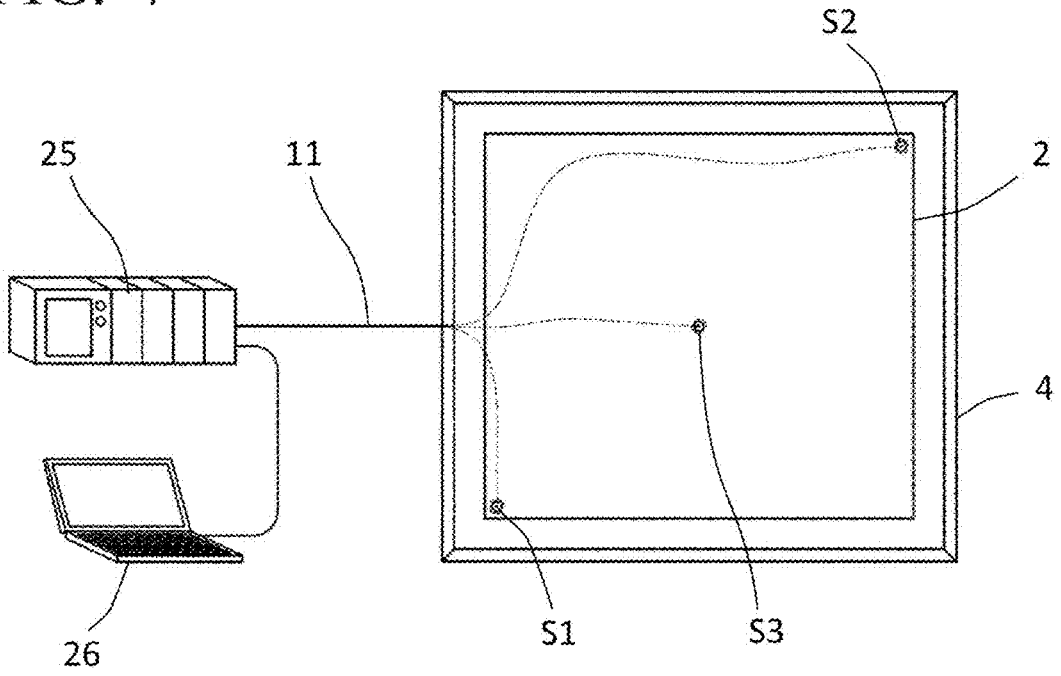
FIG. 7 is a schematic view representing a configuration of an experiment carried out herein.

Next, there follows a description of the relationship between the casting mold strength of a molded green sand mold and the pressure value (peak pressure) that is applied to the parting plane and measured by the green sand mold molding sensors. In order to investigate the relationship between the foregoing, an experiment was carried out by using a molding machine. FIG. 7 is a schematic view representing a configuration of the experiment carried out herein. Note that FIG. 7 represents: a positional relationship between a plate and a sensor; an integrated amplifier-recorder 25 that amplifies and records a signal from a pressure sensor; and a computer 26 that is connected to the integrated amplifier-recorder 25 and performs analysis such as graphing sensor measurement values. The experiment was performed as follows.

1. Green sand mold molding sensors were installed (embedded) in a plate made of aluminum. In this experiment, fluid pressure sensors were used as the green sand mold molding sensors. Installation locations were set at a total of three locations: in the center of the plate and in opposing corners of the plate. Note that for the sake of descriptions hereinafter, in the drawings, S1 and S2 are the two locations on the line between opposing corners of the plate and close to the respective apexes, and S3 is the central section of the plate. The reason for installing fluid pressure sensors at the three locations S1, S2, and S3 is so as to be able to acquire data in a large pressure range from one molding, since the force acting on the plate during molding of a green sand mold is high in the central section of the plate and low near the metal frame due to frictional resistance between the metal frame and the green sand. Further, since a fluid pressure sensor was also disposed in the central section of the plate, the present experiment was performed without attaching a model.

2. The plate having the green sand mold molding sensors installed therein was attached to a molding machine and a green sand mold was molded. In addition, during a squeezing step, the pressure applied to the parting plane was measured by the green sand mold molding sensors at the three locations. Temporal changes in the pressure value were measured and recorded in the integrated amplifier-recorder 25. With respect to squeezing, pressure was applied gradually up to a set pressure and was released when the set pressure was reached.

3. The casting mold strength of a green sand mold at positions where the pressure was measured by the green sand mold molding sensors was measured by a casting mold strength gauge and the relationship between the pressure value and the casting mold strength was investigated. Note that with respect to the strength gauge that measured the casting mold strength, an invasive-type casting mold strength gauge that is widely used in casting mold factories to evaluate moldability of a green sand mold and that measures the casting mold strength by introducing, approximately 10 mm into the casting mold, a needle having a tip diameter of approximately 3 mm was used.

In addition, the abovementioned 2 and 3 were carried out on a plurality of green sand molds and the data were collected. Table 1 summarizes these experimental conditions.

TABLE 1

| | |
|---|---|
| SQUEEZING PRESSURE (MPa) | 0.3~0.7 |
| GREEN SAND FILLING METHOD | FREE FALL |
| CASTING MOLD STRENGTH MEASURING APPARATUS | INVASIVE-TYPE CASTING MOLD STRENGTH GAUGE |
| BASE SAND OF GREEN SAND | SILICA SAND |
| PROPERTIES OF GREEN SAND | 33 ± 3 |
| COMPACTABILITY (%) | 22.1 |
| COMPRESSIVE STRENGTH (N/cm$^2$) | 224 |
| PERMEABILITY | |

(Experimental Results)

Figure 8:
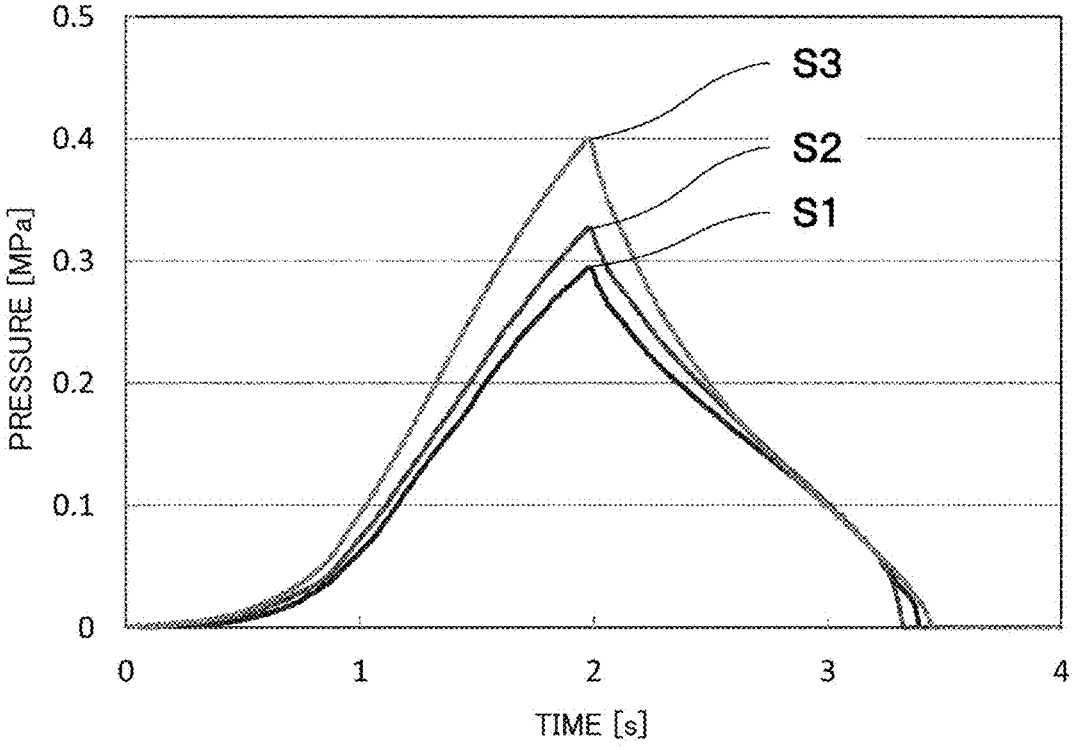
FIG. 8 is a graph representing one example of results obtained by recording, in an integrated amplifier-recorder, temporal changes in the pressure of a green sand mold molding sensor in a squeezing step and analyzing by computer.

FIG. 8 is a graph representing one example of results obtained by recording, in the integrated amplifier-recorder 25, temporal changes in the pressure of a green sand mold molding sensor in the squeezing step and analyzing by the computer 26. Note that FIG. 8 represents the case in which squeezing pressure was set at 0.4 MPa and measurements were carried out at the three locations S1, S2, and S3. As shown in FIG. 8, in this molding machine, the peak pressure was reached in the squeezing step approximately two seconds after squeezing commenced.

Further, upon confirming the relationship between the position of the plate and the peak pressure, it was understood that the pressure at the central section (S3) of the plate is the highest and pressure becomes lower at places (S1, S2) away from the central section. Due thereto, it was possible to confirm that near the metal frame, the pressure propagated to the plate decreases due to frictional resistance between the green sand and the metal frame, which was mentioned earlier. Further, in one example of these experimental results, the pressure at the central section (S3) of the plate was almost the same as the set pressure (0.4 MPa).

Figure 9:
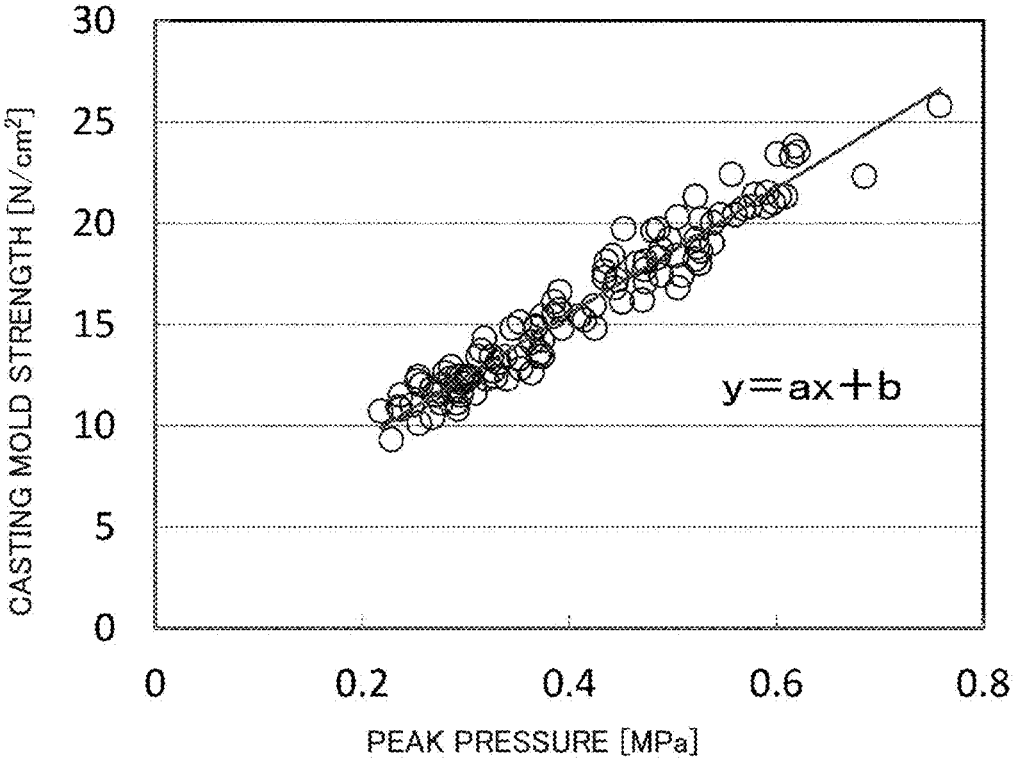
FIG. 9 is a graph summarizing a relationship between peak pressure of a green sand mold molding sensor and casting mold strength.

FIG. 9 is a graph summarizing, upon having repeated the abovementioned experiment, the relationship between the casting mold strength and the peak pressure of the green sand mold molding sensors which varies with the set squeezing pressure and the filling state of the green sand. From this graph, a positive correlation is seen in the relationship between the peak pressure of the green sand mold molding sensors and the casting mold strength and it is understood that it is possible to represent this relationship with a straight line. In addition, from the straight line, it is possible to determine the expression y=ax+b. Here, y is the casting mold strength and x is the peak pressure. From these results, it was understood that it is possible to evaluate the casting mold strength (casting mold filling properties) from the peak value of the pressure (squeezing pressure on the parting plane of the green sand mold) of the green sand mold molding sensors.

The green sand mold molding sensors measure the pressure when the filled green sand is tamped and the tamping force (compression force) reaches the plate surface. The pressure reaching this plate surface varies depending on the magnitude of the tamping force, the density distribution of the filling of the green sand before tamping (high pressure in high density portions, low pressure in low density portions), the shape of the model (pattern), and the characteristics of the green sand (low pressure in high water content sand, high pressure in low water content sand).

With respect to the evaluation of moldability by using the green sand mold molding sensors, from the relationships

- high peak pressure of green sand mold molding sensor=high filling density of green sand=high casting mold strength, and
- low peak pressure of green sand mold molding sensor=low filling density of green sand=low casting mold strength, when the peak pressure of the green sand mold molding sensor is low, there is a concern of defects such as molten metal infiltration, sand drop/sand inclusion, molten metal leakage, etc. When the peak pressure of the green sand mold molding sensor is high, sliding resistance between the model and the casting mold increases and there is a concern of mold removal defects. As such, keeping the detected peak pressure of the green sand mold molding sensors at a suitable level leads to a reduction in defects.

The pressure conveyed to the green sand mold molding sensors embedded in the plate varies due to the causes mentioned above and therefore the embedding positions of the green sand mold molding sensors must be places where it is possible to ascertain these circumstances. Accordingly, if multiple green sand mold molding sensors are installed, it is possible to detect flaws under more conditions. However, due to space constraints and from an economic perspective, this is not realistic and it is desirable to be able to detect and evaluate pressure using a smaller number of sensors.

As mentioned earlier, for the filling of green sand by the casting mold molding device 1, a gravity drop method or a blowing method that uses an airflow is employed. In the gravity drop method that uses a louvered hopper, etc., mentioned earlier, a bias when the green sand is loaded into the louvered hopper may become a bias when loading into the casting mold molding space. Further, in the blowing method, a bias may occur when loading into the casting mold molding space due to circumstances such as the distance from the blowing-in nozzle, sand blockage in the nozzle opening, etc. These biases appear as biases in the pressure propagated to the plate 2 due to the subsequent tamping of the green sand. It is necessary to dispose the green sand mold molding sensors by taking into consideration the occurrence of such biases in initial filling amounts.

In addition, in cases in which a difference in the measurement value of a disposed green sand mold molding sensor is outside a predetermined threshold value range, it can be determined that the bias of the initial filling is large and it is possible to take measures such as: improving the state in which casting mold sand is loaded into the louvered hopper; adjusting blowing-in air pressure or blowing-in time; or improving the state (blockage, abrasion, etc.) of the blowing-in nozzle. Further, the flowability of the green sand has an influence when the casting mold sand is loaded into the louvered hopper, when loaded from the louvered hopper to the casting mold molding space, or when blown-in by means of blowing, etc. This flowability of the green sand varies according to sand properties such as the water content of the green sand and it is therefore possible to adjust the sand by using a sand processing device such as a kneading machine that kneads green sand to be supplied to the casting mold molding device 1.

Further, when green sand is tamped, the green sand is compressed by a tamping force and a pressure is detected by the green sand mold molding sensors embedded in the plate. The force propagated to the plate is generally high in the (planar state) central section of the casting mold and lower in a peripheral section due to sliding resistance (or frictional resistance) between the green sand and the casting frame side surface. In the case of a rectangular casting mold, the force is lowest in corner sections near the casting frame.

As such, in order to evaluate the force (pressure) propagated to the plate due to the magnitude of the tamping force, it is preferable to dispose green sand mold molding sensors near the casting frame side surface, in particular, in the corner sections. If a measurement value of a green sand mold molding sensor disposed in this position does not reach a predetermined lower limit threshold value, it can be judged that a sufficient casting mold strength has not been reached and measures to increase the tamping force can be taken. If the measurement value is higher than an upper limit threshold value, it can be judged that the casting mold strength is more than sufficient and measures to decrease the tamping force can be undertaken.

In the present embodiment, considering the step for filling the green sand and the step for tamping the green sand, the green sand mold molding sensors 10A, 10B, 10C, 10D are embedded in the four corners of the plate 2.

Note that the relationship between the peak value of the pressure of the green sand mold molding sensors and the casting mold strength is also the same when using another type of flask molding machine or a flaskless molding machine. As such, this relationship can also be applied in a casting mold molding device of a second embodiment which is described later.

(Method for Calculating Casting Mold Strength)

Next, there follows a description of a method for calculating the casting mold strength by using the casting mold strength calculation unit 18. As mentioned above, it has been ascertained that there is a correlative relationship between the casting mold strength and the peak value of the pressure of the green sand mold molding sensors. The casting mold strength calculation unit 18 uses this relationship to calculate the casting mold strength from the casting mold strength inputted into the input unit 17 and the pressure value (peak pressure) measured by the green sand mold molding sensors 10A, 10B, 10C, 10D.

Specifically, calculation of the casting mold strength by the casting mold strength calculation unit 18 comprises two steps.

Step 1

A predetermined number of green sand molds are molded in advance and a pressure value (peak pressure) during squeezing is measured by the green sand mold molding sensors 10A, 10B, 10C, 10D. Furthermore, the casting mold strength at positions in each of the molded green sand molds where the pressure was measured by the green sand mold molding sensors 10A, 10B, 10C, 10D is measured and inputted into the input unit 17 by a worker. In addition, a worker determines the expression y=ax+b from the relationship between the casting mold strength and the pressure value (peak pressure).

Note that in the present embodiment, on the basis of the experimental results mentioned above, the green sand mold molding sensors 10A, 10B, 10C, 10D are embedded in the four corners of the plate 2. By measuring the pressure applied to the parting plane at these four locations and determining a relationship with the casting mold strength, it is possible to determine casting mold quality by using a small number of green sand mold molding sensors while taking into consideration variation in pressure on the plate upper surface. Further, when making a predetermined number of moldings, by varying the squeezing pressure, it is possible to determine a relationship between the pressure applied to the parting plane and the casting mold strength over a wider range.

Figure 10:
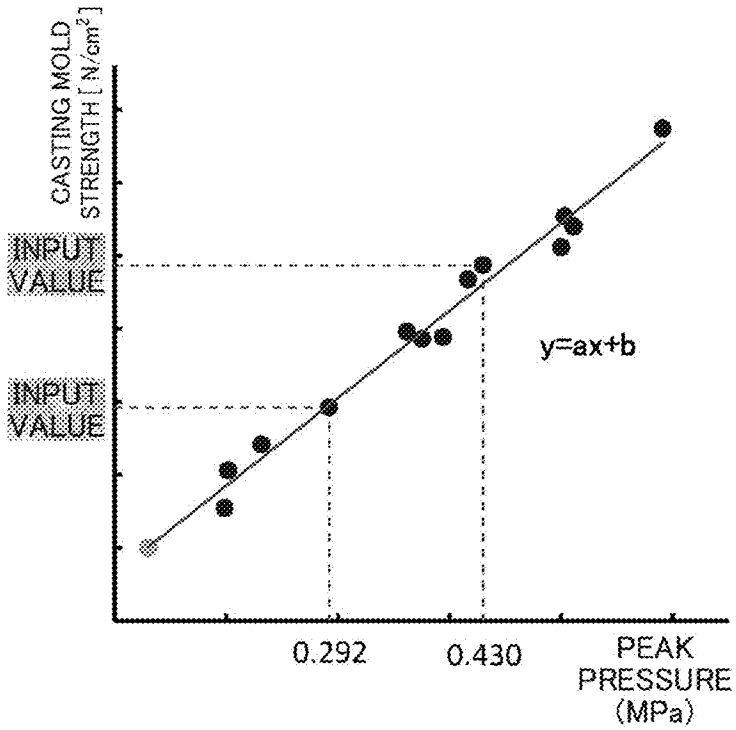
FIG. 10 shows one example of a screen displayed on a display unit.

FIG. 10 shows one example of a screen displayed on the display unit 20. In the present example, first, a predetermined green sand mold is molded and seven pressure values (peak pressures) measured by the green sand mold molding sensors 10A, 10B at that time are displayed on the screen. Note that it is also possible to switch to a screen which displays seven pressure values (peak pressures) measured by the green sand mold molding sensors 10C, 10D, and that furthermore, one screen may be configured so that seven pressure values (peak values) measured by the green sand mold molding sensors 10A, 10B, 10C, 10D are displayed on the screen.

In addition, the casting mold strength at positions in each of the molded green sand molds where the green sand mold molding sensors 10A, 10B, 10C, 10D were disposed is inputted as an input value by a worker. Here, "Peak pressure A" and "Casting mold strength A" shown in FIG. 10 are, respectively, the peak pressure value of the green sand mold molding sensor 10A and the casting mold strength at the position of the green sand mold molding sensor 10A. Further, "Peak pressure B" and "Casting mold strength B" in the FIG. 10 are, respectively, the peak pressure value of the green sand mold molding sensor 10B and the casting mold strength at the position of the green sand mold molding sensor 10B; "Peak pressure C" and "Casting mold strength C" displayed on the switched screen are, respectively, the peak pressure value of the green sand mold molding sensor 10C and the casting mold strength at the position of the green sand mold molding sensor 10C; and "Peak pressure D" and "Casting mold strength D" displayed on the switched screen are, respectively, the peak pressure value of the green sand mold molding sensor 10D and the casting mold strength at the position of the green sand mold molding sensor 10D.

The casting mold strength calculation unit 18 plots the casting mold strength and the peak value of the pressure of the green sand mold molding sensors on a graph (in the present example, 7×4=28 places). In addition, when a worker inputs predetermined values for the slope "a" and the intersect "b" of the expression, a straight line y=ax+b is displayed. While confirming the plots, a worker changes numerical values of the slope "a" and the intersect "b", as appropriate, and upon determining that there is a linear correlation among the plots, determines a final expression y=ax+b. Note that if there are no problems in terms of casting mold strength with a green sand mold for which the casting mold strength has been measured by a worker, it is possible for manufacturing to proceed as-is by carrying out subsequent steps (core setting step, molten metal pouring step, etc.). Note also that in the above description, a worker inputted the slope "a" and the intersect "b" of the expression, but these may also be determined by using a computer or a PLC and performing a linear regression by a least-squares method, etc.

Step 2

After determining the expression y=ax+b, molding of the green sand mold commences. After commencing, the expression y=ax+b is used to automatically calculate the casting mold strength at the positions of the green sand mold molding sensors 10A, 10B, 10C, 10D from the pressure value (peak pressure) measured by the green sand mold molding sensors 10A, 10B, 10C, 10D. Due thereto, there is no need for a worker to measure the casting mold strength separately.

Note that in the present example, the casting mold strength is measured using a casting mold strength gauge and the number of peak pressures and casting mold strengths displayed on the screen is seven each for A and B. However, this may be changed, as appropriate, according to the specifications of the casting mold molding device 1, specifications such as shape and size of the green sand mold to be molded, etc., or the specifications of the green sand.

(Method for Determining Casting Mold Quality)

Next, there follows a description of a method for determining casting mold quality by using the casting mold quality determination unit 19. The casting mold quality determination unit 19 determines the quality of a green sand mold from the threshold value of the casting mold strength inputted into the input unit 17 and the casting mold strength calculated by the casting mold strength calculation unit 18.

Specifically, determination of the casting mold quality by the casting mold quality determination unit 19 comprises two steps.

Step 1

First, a worker inputs a threshold value of the casting mold strength of a green sand mold to be molded. FIG. 11 shows one example of a screen displayed on the display unit 20. In the present example, specific threshold values inputted by a worker are displayed. Here, "Sensor A strength normal range" in FIG. 11 indicates the lower limit value and the upper limit value of the casting mold strength at the position of the green sand mold molding sensor 10A; "Sensor B strength normal range" in FIG. 11 indicates the lower limit value and the upper limit value of the casting mold strength at the position of the green sand mold molding sensor 10B; "Sensor C strength normal range" in FIG. 11 indicates the lower limit value and the upper limit value of the casting mold strength at the position of the green sand mold molding sensor 10C; and "Sensor D strength normal range" in FIG. 11 indicates the lower limit value and the upper limit value of the casting mold strength at the position of the green sand mold molding sensor 10D. Further, "Casting mold strength difference (Max.–Min.) abnormality value" shown in FIG. 11 indicates a threshold value wherein the difference between the maximum and minimum values of the casting mold strength determined from the pressure value of the green sand mold molding sensors 10A, 10B, 10C, 10D is set as an abnormality value. In the present example, the lower limit value of the casting mold strength at the position of the green sand mold molding sensors 10A, 10B, 10C, 10D is set as 10.0 (N/cm2), the upper limit value of the same is set as 20.0 (N/cm2), and the threshold value wherein the difference between the maximum value and the minimum value of the casting mold strength at the position of the green sand mold molding sensors 10A, 10B, 10C, 10D is set as an abnormality value is set as 5.0 (N/cm2).

Step 2

After the expression y=ax+b is determined by the casting mold strength calculation unit 18 and the threshold value of the casting mold strength is inputted, molding of the green sand mold commences. After commencing, the casting mold strength at the position of the green sand mold molding sensors 10A, 10B, 10C, 10D is automatically calculated from the pressure value (peak pressure) measured by the green sand mold molding sensors 10A, 10B, 10C, 10D. In addition, the quality of a green sand mold is determined from the inputted threshold value of the casting mold strength and the calculated casting mold strength. Here, determination of the quality of a green sand mold is performed as follows. In the present example, the threshold values of the casting mold strength A, the casting mold strength B, the casting mold strength C, and the casting mold strength D are each set as 10.0 (N/cm2) or more and 20.0 (N/cm2) or less, and the abnormality threshold value of the difference between the maximum value and the minimum value of the casting mold strength at the positions of the green sand mold molding sensors 10A, 10B, 10C, 10D is set as 5.0 (N/cm2) or more.

Accordingly, in the case in which the casting mold strength at the position of the green sand mold molding sensor 10A is 13.0 (N/cm2), the casting mold strength at the position of the green sand mold molding sensor 10B is 12.0 (N/cm2), the casting mold strength at the position of the green sand mold molding sensor 10C is 16.0 (N/cm2), and the casting mold strength at the position of the green sand mold molding sensor 10D is 14.0 (N/cm2), the casting mold strength A, the casting mold strength B, the casting mold strength C, and the casting mold strength D are all within the threshold values. Furthermore, the maximum value of the casting mold strengths A, B, C, D is 16.0 (N/cm2), the minimum value is 12.0 (N/cm2), and the difference between the maximum and the minimum is 4.0 (N/cm2), which is within the range, and therefore the casting mold quality determination unit 19 determines that the casting mold quality is OK.

In contrast thereto, in the case in which the casting mold strength at the position of the green sand mold molding sensor 10A is 11.0 (N/cm2), the casting mold strength at the position of the green sand mold molding sensor 10B is 17.0 (N/cm2), the casting mold strength at the position of the green sand mold molding sensor 10C is 12.0 (N/cm2), and the casting mold strength at the position of the green sand mold molding sensor 10D is 16.0 (N/cm2), the casting mold strength A, the casting mold strength B, the casting mold strength C, and the casting mold strength D are all within the threshold values. However, the maximum value of the casting mold strengths A, B, C, D is 17.0 (N/cm2), the minimum value is 11.0 (N/cm2), and the difference between the maximum and the minimum is 6.0 (N/cm2), which is not within the range, and therefore the casting mold quality determination unit 19 determines that the casting mold quality is faulty.

FIG. 12 shows one example of a screen displayed on the display unit 20. Here, "Peak pressure A", "Peak pressure B", "Peak pressure C", and "Peak pressure D" in FIG. 12 indicate, respectively, the peak pressure value of the green sand mold molding sensor 10A, the peak pressure value of the green sand mold molding sensor 10B, the peak pressure value of the green sand mold molding sensor 10C, and the peak pressure value of the green sand mold molding sensor 10D. Further, "Casting mold strength A", "Casting mold strength B", "Casting mold strength C", and "Casting mold strength D" indicate, respectively, the casting mold strength at the position of the green sand mold molding sensor 10A calculated by the casting mold strength calculation unit 18, the casting mold strength at the position of the green sand mold molding sensor 10B calculated by the casting mold strength calculation unit 18, the casting mold strength at the position of the green sand mold molding sensor 10C calculated by the casting mold strength calculation unit 18, and the casting mold strength at the position of the green sand mold molding sensor 10D calculated by the casting mold strength calculation unit 18.

Furthermore, "Casting mold strength difference (Max.–Min.)" in FIG. 12 indicates the difference between the maximum value and the minimum value of the casting mold strengths A, B, C, D. Further, "Determination" in FIG. 12 indicates a determination result for the casting mold quality by the casting mold quality determination unit 19.

Note that on the screen of the display unit 20 in FIG. 12, a poor numerical value is displayed by shading or coloring the inside of a cell, and OK (normal) and FT (faulty) can be understood at a glance.

Note that the threshold values and the difference between the maximum value and the minimum value set for the casting mold strength A, the casting mold strength B, the casting mold strength C, and the casting mold strength D are determined, as appropriate, in accordance with the specifications of the casting mold molding device 1, specifications such as shape, size, etc., of the green sand mold to be molded, the site of the green sand mold, or the specifications of the green sand, etc. In addition, these values are associated with a model number.

In the casting mold molding device 1 of the present embodiment, even if the specifications such as shape, size, etc., of a green sand mold to be molded change, in each case, it is possible for the casting mold strength calculation unit 18 to calculate the casting mold strength and for the casting mold quality determination unit 19 to determine the quality of the molded green sand mold from the calculated casting mold strength.

(Method for Evaluating Casting Mold Quality Using Casting Mold Molding Device)

Figure 13:
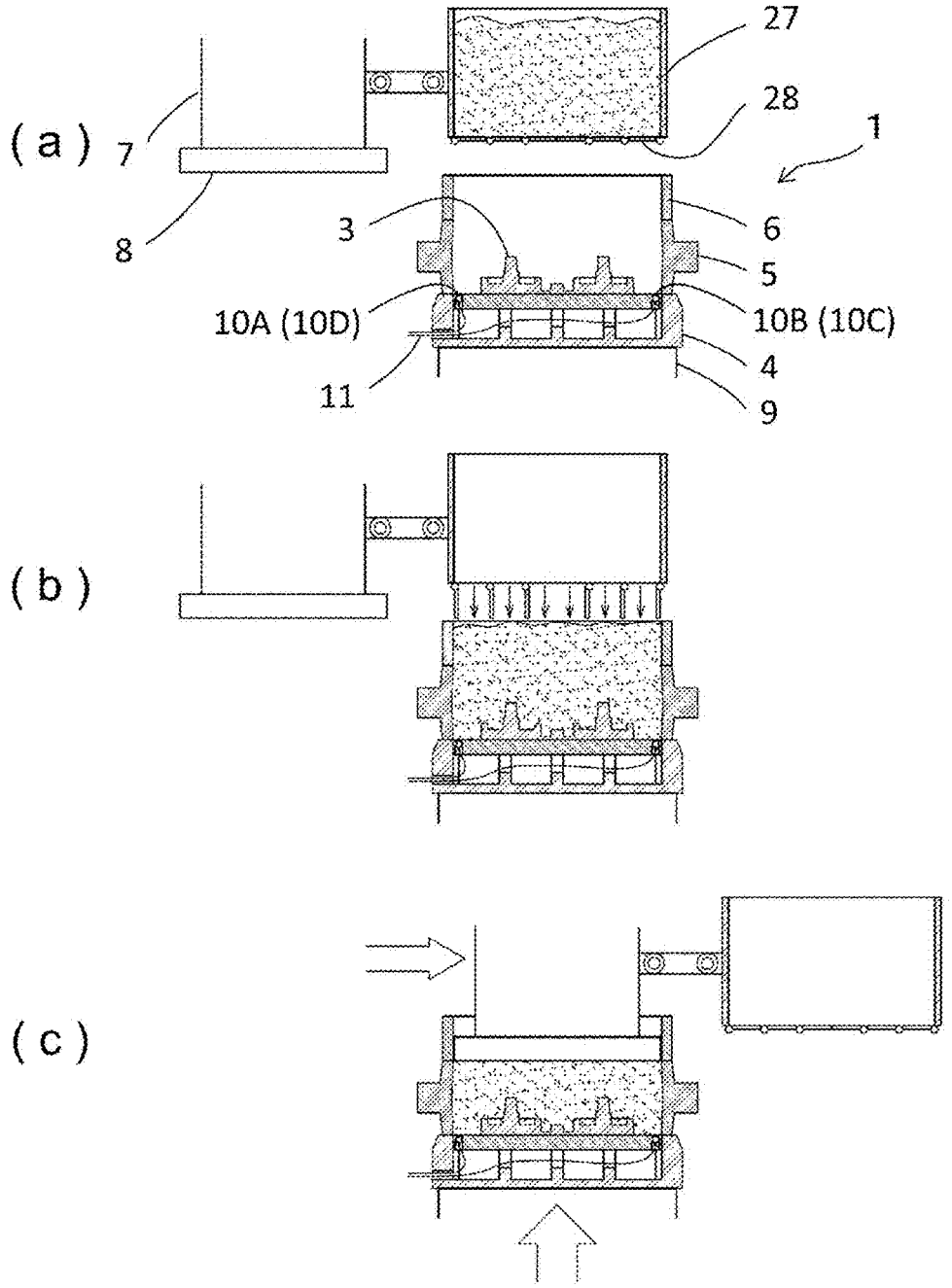
FIG. 13 shows steps in a method for evaluating casting mold quality (method for molding a green sand mold) using the casting mold molding device according to the first embodiment.

Next, there follows a description of a method for evaluating casting mold quality (method for molding a green sand mold) using the casting mold molding device 1. FIG. 13 shows steps in a method for evaluating casting mold quality (method for molding a green sand mold) using the casting mold molding device 1 according to the first embodiment. Note that in FIG. 13, a louvered hopper 27 is coupled to the squeeze head 7 of the casting mold molding device 1 shown in FIG. 1. The louvered hopper 27 has a structure wherein a predetermined amount of green sand is loaded therein from a green sand transportation device (not shown) and, after having been briefly retained, louvers 28 at a lower portion of the louvered hopper 27 open and the green sand is loaded into the casting mold molding space.

Molding of a green sand mold by the casting mold molding device 1 follows the procedure described below.

1. When molding is commenced, a table 9 rises and thereby a state shown in FIG. 13(*a*) is achieved. At this time, a predetermined amount of green sand is loaded into the louvered hopper 27 from the green sand transportation device (not shown).

2. Then, as shown in FIG. 13(*b*), the louvers 28 at a lower portion of the louvered hopper 27 open and the green sand inside the louvered hopper 27 is loaded into the casting mold molding space defined by the plate 2, the metal frame 5 and the filling frame 6.

3. Then, as shown in FIG. 13(*c*), the coupled squeeze head 7 and louvered hopper 27 move, the squeeze board 8 is arranged directly above the casting mold molding space, and next, the table 9 rises and thereby the green sand inside the casting mold molding space is squeezed (compressed). At this time, the green sand mold molding sensors 10A, 10B, 10C, 10D measure the pressure value (peak pressure) at the parting plane. Note that the casting mold is molded in the present step. At this time, the green sand mold molding sensors 10A, 10B, 10C, 10D are between the wall of the metal frame 5 and the model 3 in the plate 2.

4. The pressure value (peak pressure) at the parting plane is transmitted to the casting mold quality evaluation device 12 and the quality of the green sand mold that has just been molded is evaluated.

Quality evaluation by the casting mold quality evaluation device 12 is performed after the expression y=ax+b, which represents the relationship between casting mold strength and the peak value of the pressure of the green sand mold molding sensors, has been determined in advance. In addition, a green sand mold determined to be OK by the casting mold quality evaluation device 12 flows, as-is, along the line and subsequent steps (molten metal pouring, etc.) are carried out. Meanwhile, a green sand mold determined to be faulty by the casting mold quality evaluation device 12 flows, as-is, along the line, but subsequent steps (molten metal pouring, etc.) are not carried out. The green sand mold skips these steps and, as a casting mold to be discarded, is shaken out from the mold in the same way as a green sand mold having a casting mold quality evaluation determined as being OK. Thus, it is possible to make a determination of "good" or "poor" with respect to the quality of a molded casting mold for each frame, which can therefore lead to a casting mold quality assurance for each frame. Further, it is possible to judge a defect at the time of molding a green sand mold and therefore it is possible to reduce defects in castings produced. Furthermore, it is possible to omit unnecessary work and therefore it is possible to reduce production costs.

5. Then, in the casting mold molding device 1, the table 9 lowers, the filling frame 6 separates from the metal frame 5 upper surface, and when the table lowers further, the metal frame 5 containing the green sand mold is placed on a roller conveyor connected to subsequent steps such as core-setting, molten metal pouring, etc., the model 3 is removed from the green sand mold, and the lowering of the table 9 stops. Next, the metal frame 5 containing the green sand mold is conveyed on the roller conveyor to a subsequent step and the metal frame 5 is loaded into the casting mold molding device 1 in preparation for the next molding. Note that when the lowering of the table 9 commences, a predetermined amount of green sand is supplied to the louvered hopper 27 with the louvers 28 closed.

6. When the metal frame 5 has been loaded in preparation for the next molding and the supplying of green sand to the louvered hopper 27 has been completed, the coupled squeeze head 7 and louvered hopper 27 move, the table 9 rises in a state in which the louvered hopper 27 is arranged directly above the casting mold molding space, and molding of the next green sand mold commences.

In addition, pressure value data, casting mold strength data associated with pressure values, casting mold strength calculation results, and casting mold quality determination results, etc., which are produced during the molding step, are all recorded in the recording unit 22 of the casting mold quality evaluation device 12. Therefore, it is possible to use these numerical values to monitor the operational state of the casting mold molding device 1 and these numerical values are useful in quality control, maintenance, and troubleshooting of the casting mold molding device 1. Furthermore, using these numerical values can lead to early detection of defect causes such as: sand spillage, burn-in of a casting, and mold drop which occur due to filling defects; and swelling of a green sand mold due to molten metal pressure after pouring.

Furthermore, the data recorded in the recording unit 22 are recorded for each model attached to the plate 2. Therefore, it is possible to compare and examine a state, such as a defect in a green sand mold, with pressure value data, and setting of a more accurate threshold value becomes possible.

Further, in the present embodiment, a worker determines the expression y=ax+b by considering the slope "a" and the intercept "b" of the expression from the casting mold strengths and peak values of the pressure of the green sand mold molding sensors plotted on a graph. However, it is also possible to configure so that the casting mold strength calculation unit 18 automatically calculates the expression y=ax+b from the relationship between the casting mold strength and the peak value of the pressure of the green sand mold molding sensors by using a computer or a PLC and performing a linear regression by a least-squares method, etc.

Further, in the present embodiment, in the case that a molded green sand mold is determined to be a defect, a worker clarifies that the green sand mold in question is a defect. However, it is also possible to configure so that a determination result is automatically communicated to casting mold equipment of a subsequent step (molten metal pouring, etc.). In that case, at a subsequent step, the casting mold equipment automatically recognizes that the green sand mold in question is a defect, omits (skips) the step, and finally the green sand mold in question is shaken out from the mold.

Further, in the present embodiment, the green sand mold molding sensors 10A, 10B, 10C, 10D are embedded in the four corners of the plate 2. However, even if the number of green sand mold molding sensors embedded in the plate 2 is smaller, it is possible to calculate the relationship between the casting mold strength and the peak value of the pressure of the green sand mold molding sensors. In that case, accuracy is slightly lower in comparison with the case in which green sand mold molding sensors are embedded in four locations, but it is possible to curb costs.

Figure 14:
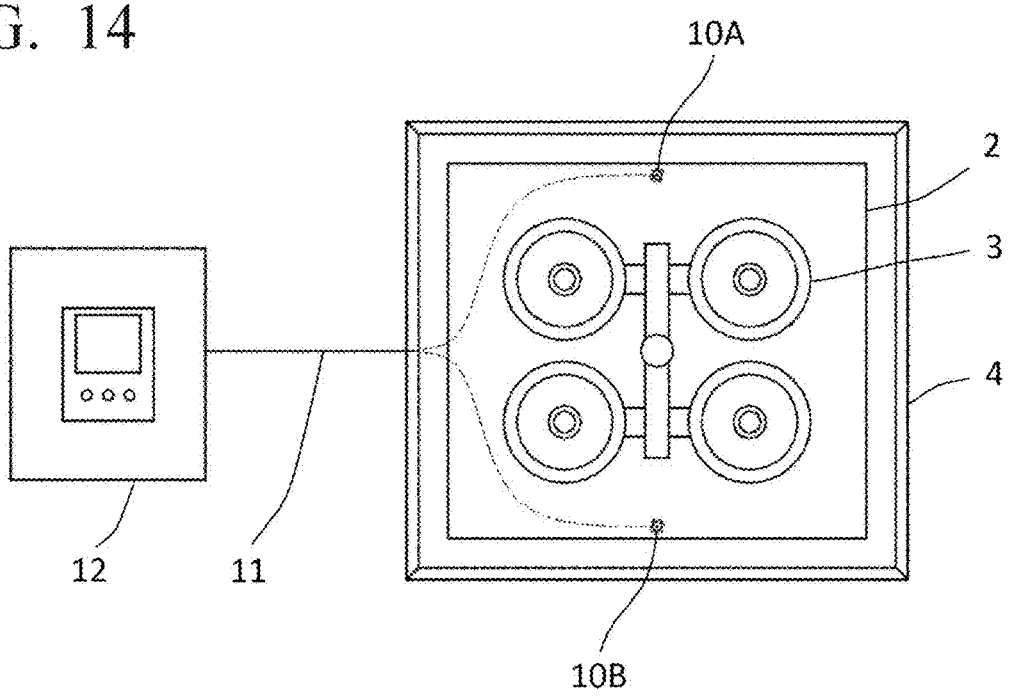
FIG. 14 shows another example of a plate having green sand mold molding sensors embedded therein.
Figure 15:
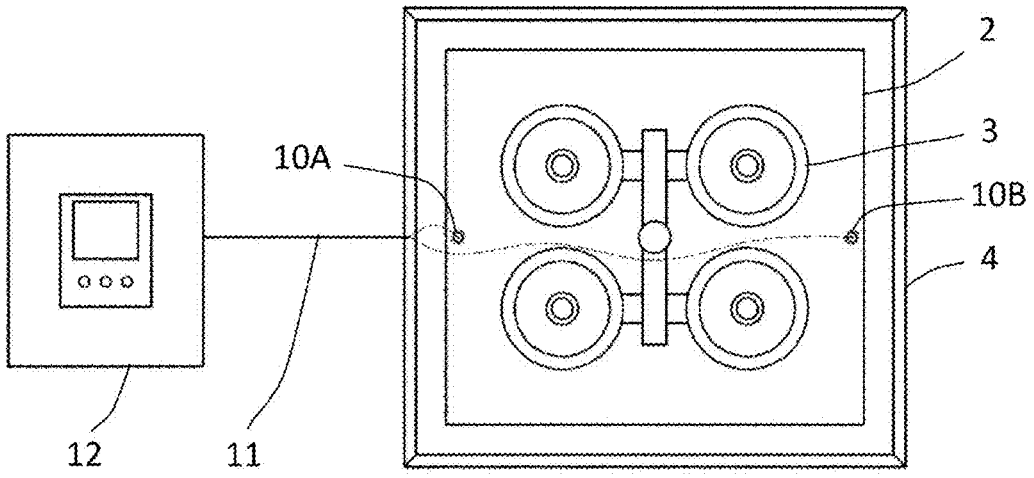
FIG. 15 shows another example of a plate having green sand mold molding sensors embedded therein.

In that case, it is also possible to embed green sand mold molding sensors at two locations on a line between opposing corners shown in FIG. 2: positions 10A and 10B; or 10C and 10D. FIGS. 14 and 15 show other examples of the plate 2 having green sand mold molding sensors 10A, 10B embedded therein. In FIG. 14, the two green sand mold molding sensors 10A, 10B are embedded near the central section of the long sides of the plate 2. In FIG. 15, the two green sand mold molding sensors 10A, 10B are embedded near the central section of the short sides of the plate 2.

(Mode of Plate)

Figure 16:
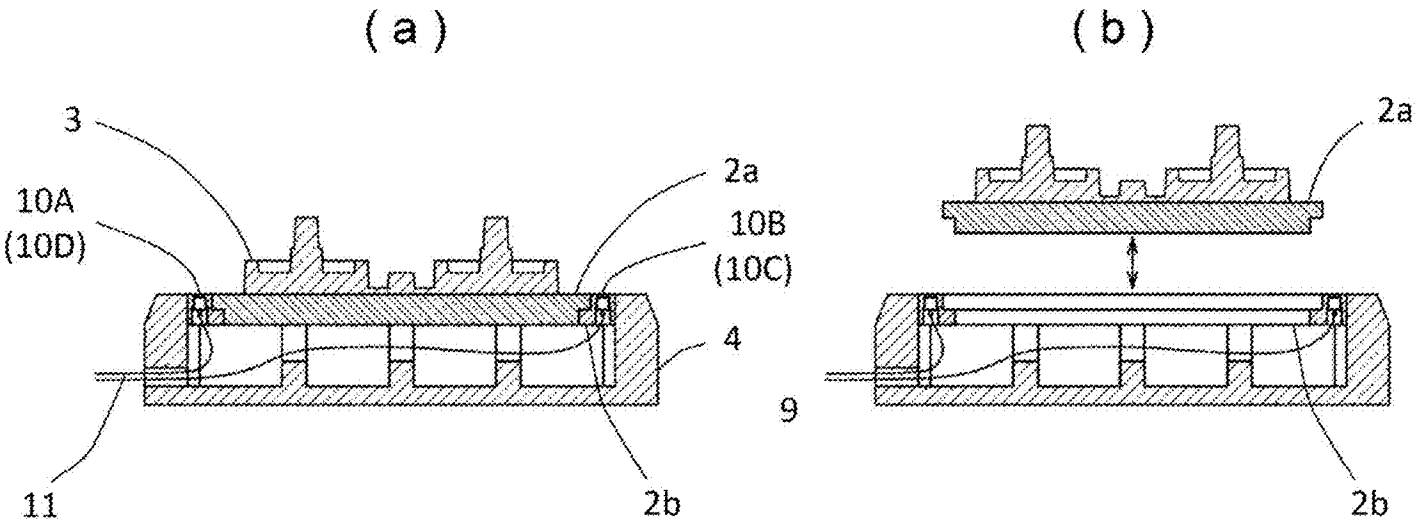
FIG. 16 shows a different mode of a plate.

FIG. 16 shows a different mode of the plate 2. FIG. 16(*a*) shows a plate 2*a* and a plate 2*b* which are placed on the carrier 4. In other words, the plate 2 is divided into a central plate 2*a* and a peripheral plate 2*b*. The central plate 2*a* and the peripheral plate 2*b* are fixed by bolts (not shown).

The model 3 is attached to an upper surface of the central plate 2*a*. Further, the green sand mold molding sensors 10A, 10B, 10C, 10D are embedded in the peripheral plate 2*b*. The shapes of the central plate 2*a* and the peripheral plate 2*b* are configured while taking into consideration the shape of the model for molding in the casting mold molding device 1 and the positions of the green sand mold molding sensors mentioned above. The shapes of alignment sections of the central plate 2*a* and the peripheral plate 2*b* are configured so as to share a common shape, and when a model for molding in the casting mold molding device 1 is to be changed, the central plate 2*a* which has the model 3 attached thereto only needs to be replaced.

FIG. 16(*b*) shows a state wherein the central plate 2*a* is detached. By loosening the bolts (not shown) and removing only the central plate 2*a*, which has the model 3 attached thereto, and attaching a central plate having a different model attached thereto, it is possible to easily exchange models without affecting the green sand mold molding sensors.

Thus, according to the green sand mold molding sensor of the first embodiment, in order to determine the quality of a molded casting (casting mold strength), it is possible to measure, during molding of a green sand mold, a pressure value (peak pressure) applied to a parting plane which is a joining section between the plate 2 and the upper mold (or lower mold) comprising green sand mold sand formed inside the casting mold molding space.

Second Embodiment

Next, there follows a description of a second embodiment of the green sand mold molding sensor and the method for evaluating green sand mold moldability according to the present invention. Note that in the second embodiment described below, for configurations common with the first embodiment, the same reference signs are used in the drawings and descriptions thereof are omitted. In the second embodiment, a flaskless molding machine, rather than a flask molding machine, is used.

Figure 17:
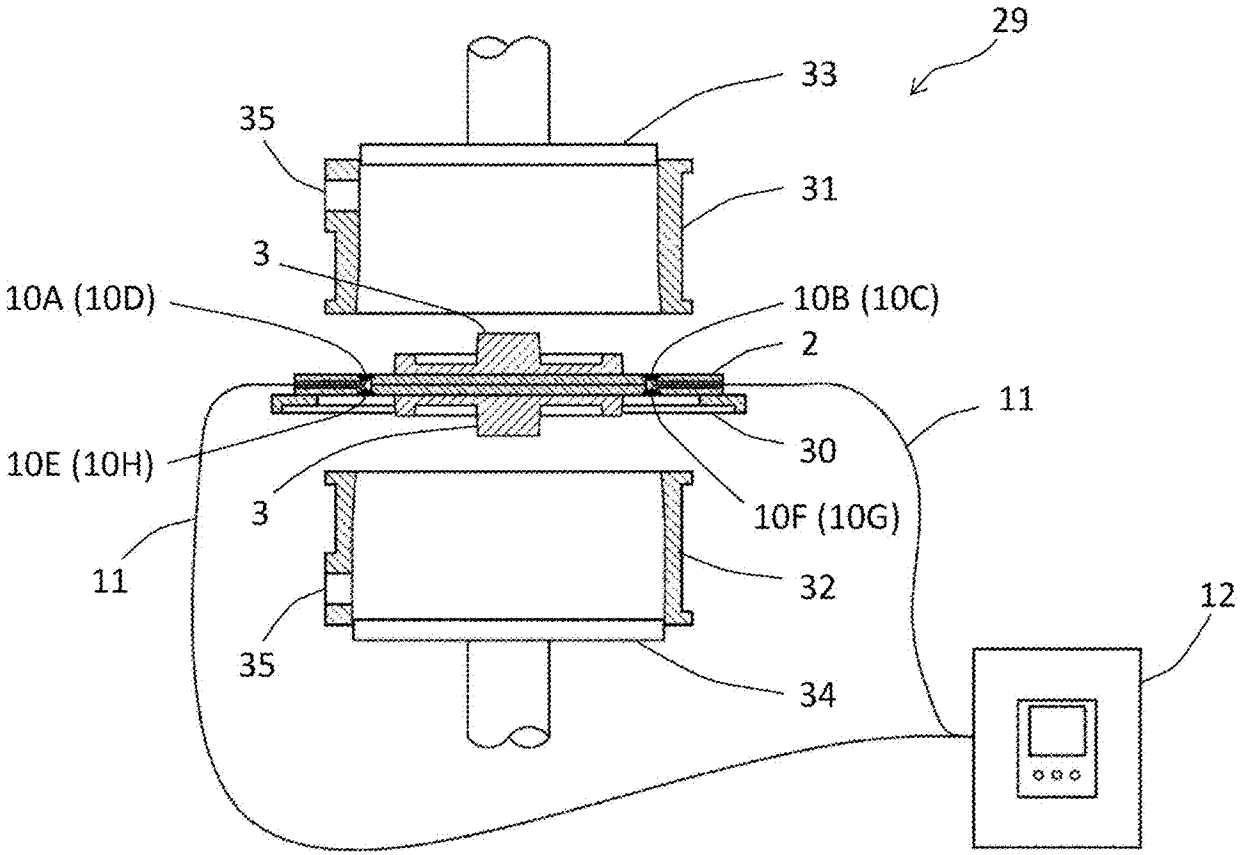
FIG. 17 represents a schematic of a structure of a casting mold molding device using green sand mold molding sensors according to a second embodiment.
Figure 18:
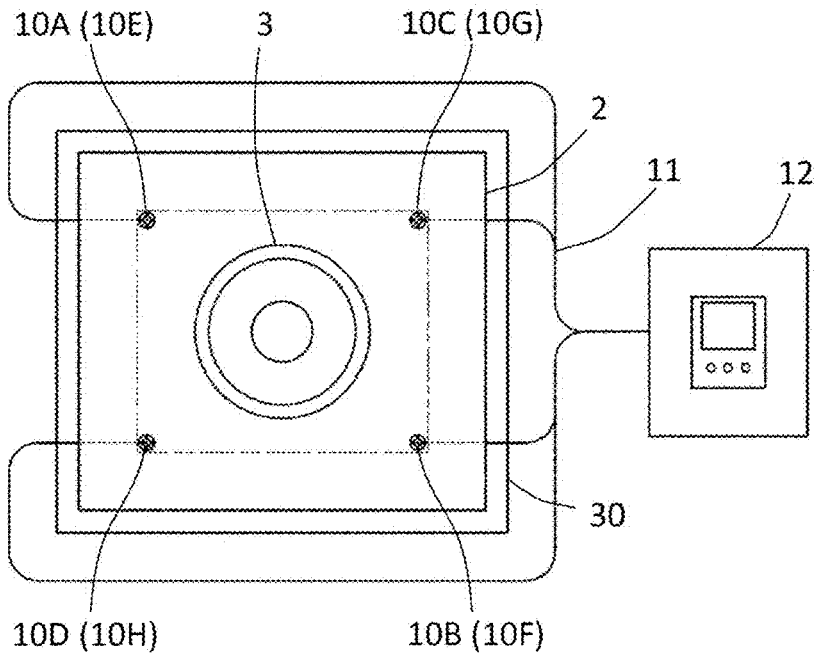
FIG. 18 represents a configuration of a portion of a casting mold molding device, wherein the portion evaluates casting mold quality.

The second embodiment will be described with reference to the attached drawings. FIG. 17 represents a schematic of a structure of the casting mold molding device using green sand mold molding sensors according to the second embodiment and FIG. 18 represents a configuration of a portion of the casting mold molding device, wherein the portion evaluates casting mold quality. The casting mold molding device according to the present embodiment is a flaskless molding machine in which, after a green sand mold is molded, the green sand mold is removed from a casting frame.

A casting mold molding device 29 comprises the plate 2 having the model 3 attached to the upper and lower surfaces thereof, a shuttle dolly 30, a cope (metal frame) 31, a drag (metal frame) 32, an upper squeeze board 33, a lower squeeze board 34, the green sand mold molding sensors 10A, 10B, 10C, 10D embedded in the upper surface of the plate 2, green sand mold molding sensors 10E, 10F, 10G, 10H embedded in the lower surface of the plate 2, the wiring 11, and the casting mold quality evaluation device 12. Note that FIG. 18 represents the plate 2, the model 3 attached to the upper surface thereof, the shuttle dolly 30, and the green sand mold molding sensors 10A, 10B, 10C, 10D as seen when viewed from the upper side of the plate 2 of the casting mold molding device 29. Note also that the green sand mold molding sensors 10E, 10F, 10G, 10H are embedded in the lower surface of the plate 2 and are therefore not shown in FIG. 18.

The plate 2 has attached to the upper and lower surfaces thereof a model 3 for molding a shape of a casting in a green sand mold and is rectangular. The shuttle dolly 30 has the plate 2 placed thereon and makes round trips between the inside and the outside of the casting mold molding device 29 in accordance with the step. The cope 31 has green sand filled therein in order to mold an upper mold of the green sand mold. In other words, the casting mold molding space surrounded by the cope 31, the upper squeeze board 33, and the plate 2 is filled with green sand. The drag 32 has green sand filled therein in order to mold a lower mold of the green sand mold. In other words, the casting mold molding space surrounded by the drag 32, the lower squeeze board 34, and the plate 2 is filled with green sand. The plate 2 is a member that constitutes a part of a boundary of the molding space defined by the cope 31 or the drag 32 during green sand mold molding by the casting mold molding device 29.

For the filling of green sand by the casting mold molding device 29, a blowing method that uses an airflow is employed. The blowing method is a method for filling green sand by blowing in green sand to the upper and lower surfaces of the plate 2 from green sand blowing-in ports 35, 35 of the cope 31 and drag 32.

The upper squeeze board 33 and the lower squeeze board 34 act via a cylinder (not shown), and the upper and lower green sand molds are molded simultaneously by tamping and compressing the green sand filled in the cope 31 and the green sand filled in the drag 32.

(Green Sand Mold Molding Sensor)

The green sand mold molding sensors 10A, 10B, 10C, 10D and 10E, 10F, 10G, 10H measure, during molding of a green sand mold, a pressure value (peak pressure) applied to a parting plane which is a joining section of the plate 2 between the upper mold comprising green sand formed inside the cope 31 and the lower mold comprising green sand formed inside the drag 32. The green sand mold molding sensors 10A, 10B, 10C, 10D and 10E, 10F, 10G, 10H are pressure sensors. In the present embodiment, the green sand mold molding sensors 10A, 10B, 10C, 10D and 10E, 10F, 10G, 10H are embedded in the four corners of the upper and lower surfaces of the plate 2. The reason that the green sand mold molding sensors 10A, 10B, 10C, 10D, and 10E, 10F, 10G, 10H are embedded in such a way is the same as the reason described in the first embodiment.

In addition, the green sand mold molding sensors 10A, 10B, 10C, 10D, and 10E, 10F, 10G, 10H have a pressure-receiving surface for measuring pressure that is exposed in the upper surface or lower surface of the plate 2 and measures the pressure value (peak pressure) applied to the parting plane above and below the plate 2. At this time, it is desirable for the pressure-receiving surface of the green sand mold molding sensors 10A, 10B, 10C, 10D and 10E, 10F, 10G, 10H and the upper and lower surfaces of the plate 2 to be in a flush state with no differences in level therebetween. Due thereto, it is possible to measure the precise pressure.

The wiring 11 connects the casting mold quality evaluation device 12 to the green sand mold molding sensors 10A, 10B, 10C, 10D, and 10E, 10F, 10G, 10H. In the present embodiment, the green sand mold molding sensors 10A, 10B, 10C, 10D, and 10E, 10F, 10G, 10H, and the casting mold quality evaluation device 12 are connected by wire via the wiring 11 but may also be connected wirelessly. For example, it is possible to use wireless communication such as a wireless LAN or Bluetooth, etc., to transmit the pressure value (pressure value data) detected by the green sand mold molding sensors 10A, 10B, 10C, 10D, and 10E, 10F, 10G, 10H to the casting mold quality evaluation device 12.

The casting mold quality evaluation device 12 evaluates the quality of the green sand mold molded by the casting mold molding device 29 from the pressure value (pressure value data) measured by the green sand mold molding sensors 10A, 10B, 10C, 10D, and 10E, 10F, 10G, 10H. The casting mold quality evaluation device 12 comprises a receiving unit 15, an amplification unit 16, an input unit 17, a casting mold strength calculation unit 18, a casting mold quality determination unit 19, a display unit 20, a transmission unit 21, and a recording unit 22.

The receiving unit 15 receives the pressure value (pressure value data) measured by the green sand mold molding sensors 10A, 10B, 10C, 10D and 10E, 10F, 10G, 10H. The amplification unit 16 amplifies the signal amount of the received pressure value (pressure value data). The input unit 17 inputs: the casting mold strength of a molded green sand mold, measured by a casting mold strength gauge; values of a slope "a" and an intercept "b" of the expression y=ax+b; and a threshold value of the casting mold strength of a green sand mold to be molded, etc.

From the casting mold strength inputted into the input unit 17 and the pressure value (peak pressure) measured by the green sand mold molding sensors 10A, 10B, 10C, 10D, and 10E, 10F, 10G, 10H, the casting mold strength calculation unit 18 uses the relational expression between the casting mold strength and the measurement values to calculate the casting molding strength for each pressure value (peak pressure) measured by the green sand mold molding sensors 10A, 10B, 10C, 10D and 10E, 10F, 10G, 10H.

The casting mold quality determination unit 19 determines the quality of a molded green sand mold from the threshold value of the casting mold strength inputted into the input unit 17 and the calculated casting mold strength. The display unit 20 displays on a screen: the pressure value (peak pressure) measured by the green sand mold molding sensors 10A, 10B, 10C, 10D and 10E, 10F, 10G, 10H; values of the slope "a" and the intercept "b" of the relational expression y=ax+b between the casting mold strength inputted by a worker using the input unit 17 and the pressure value (peak pressure); the threshold value of the casting mold strength of a green sand mold to be molded that was inputted by a worker; the casting mold strength calculation result; and the casting mold quality determination result, etc.

The transmission unit 21 transmits fault-determination data to the Patlite 23, etc. The recording unit 22 records pressure value data, casting mold strength data associated with pressure values, casting mold strength calculation results, and casting mold quality determination results, etc.

(Method for Evaluating Casting Mold Quality Using Casting Mold Molding Device)

Figure 19:
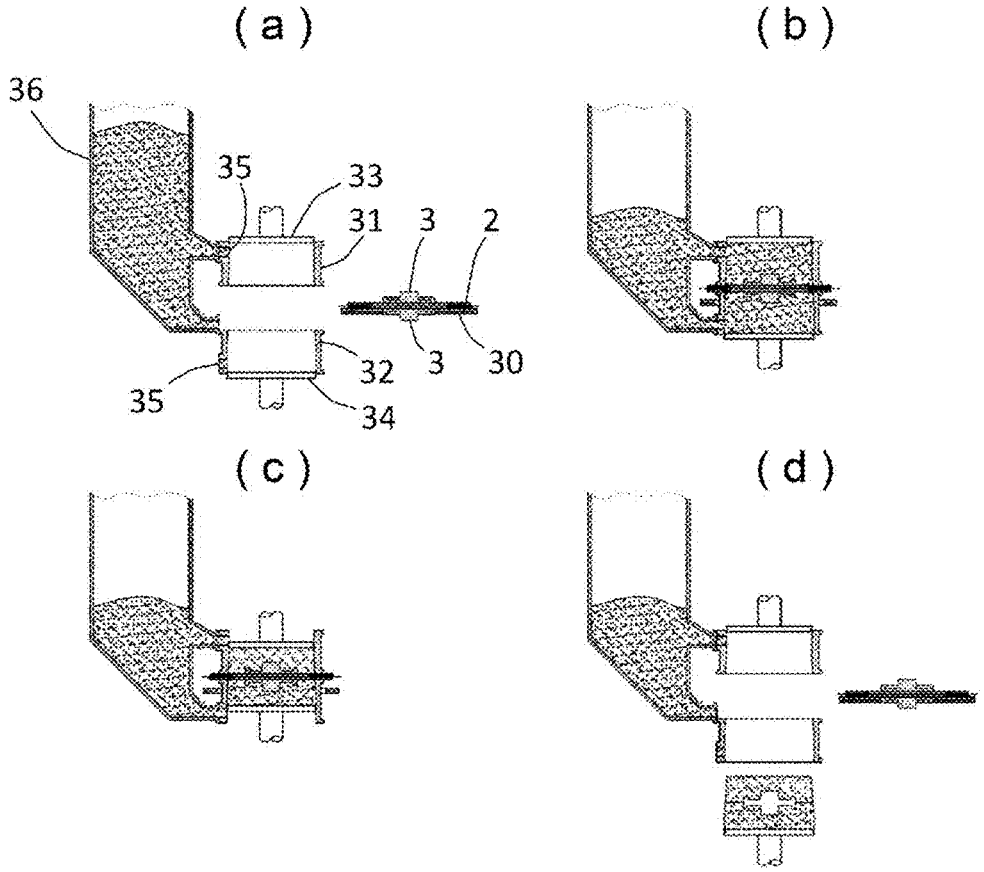
FIG. 19 shows steps in a method for evaluating casting mold quality (method for molding a green sand mold) using the casting mold molding device according to the second embodiment.

Next, there follows a description of a method for evaluating casting mold quality (method for molding a green sand mold) using the casting mold molding device 29. FIG. 19 shows steps in a method for evaluating casting mold quality (method for molding a green sand mold) using the casting mold molding device 29 according to the second embodiment. Note that in FIG. 19, a sand tank 36 is adjacent to the casting mold molding device 29 shown in FIG. 17. A predetermined amount of green sand is loaded into the sand tank 36 from the green sand transportation device (not shown) and, after having been briefly retained, a loading hole is closed and when compressed air is supplied inside the sand tank 36, green sand is filled by being blown into the upper and lower casting mold molding spaces via green sand blowing-in ports 35, 35 in the cope 31 and the drag 32.

Molding of a green sand mold by the casting mold molding device 29 follows the procedure described below.

1. When molding commences, from the state shown in FIG. 19(*a*), the shuttle dolly 30 having placed thereon the plate 2, which has the models 3, 3 attached thereto and the green sand mold molding sensors 10A, 10B, 10C, 10D and 10E, 10F, 10G, 10H embedded therein, moves between the cope 31 and the drag 32.
2. Next, the lower squeeze board 34 and the drag 32 rise, lift the plate 2 from the shuttle dolly 30, and when the state shown in FIG. 19(*b*) is set, compressed air is supplied to the sand tank 36 and green sand is filled by being blown into the upper and lower casting mold molding spaces via the green sand blowing-in ports 35, 35 in the cope 31 and the drag 32.
3. Next, due to the action of a cylinder (not shown), the upper and lower squeeze boards 33, 34 squeeze (compress) the green sand inside the cope 31 and the drag 32 and the state shown in FIG. 19(*c*) is achieved. At this time, the green sand mold molding sensors 10A, 10B, 10C, 10D and 10E, 10F, 10G, 10H measure the pressure value (peak pressure) at the parting plane. Note that green sand molds are molded in the present step. At this time, the green sand mold molding sensors 10A, 10B, 10C, 10D and 10E, 10F, 10G, 10H are between the model 3 and the walls of the cope 31 and the drag 32 of the plate 2. At this time, the measured pressure value (peak pressure) is transmitted to the casting mold quality evaluation device 12 and the quality of the green sand mold that has just been molded is evaluated.

Quality evaluation by the casting mold quality evaluation device 12 is performed after the expression y=ax+b, which represents the relationship between casting mold strength and the peak value of the pressure of the green sand mold molding sensors, has been determined in advance. In addition, a green sand mold determined to be OK by the casting mold quality evaluation device 12 flows, as-is, along the line and subsequent steps (molten metal pouring, etc.) are carried out. Meanwhile, a green sand mold determined to be faulty by the casting mold quality evaluation device 12 flows, as-is, along the line, but subsequent steps (molten metal pouring, etc.) are not carried out. The green sand mold skips these steps and, as a casting mold to be discarded, is shaken out from the mold in the same way as a green sand mold for which the casting mold quality is determined to be OK.

4. Next, the lower squeeze board 34 and the drag 32 lower and when the plate 2 is placed on the shuttle dolly 30, a state in which the models 3, 3, are removed from the upper and lower green sand molds is reached. Then, the shuttle dolly 30 moves to the position shown in FIG. 19(*a*) and when the lower squeeze board 34 and the drag 32 rise again, mold alignment of the upper and lower green sand molds is carried out by aligning the cope 31 and the drag 32. At this time, the upper and lower green sand molds are in a state of being sandwiched by the upper squeeze board 33 and the lower squeeze board 34. From this state, when the upper squeeze board 33 and the lower squeeze board 34 lower, the aligned upper and lower green sand molds are lowered and removed from the cope 31 and the drag 32 to reach the state shown in FIG. 19(*d*).

5. The aligned upper and lower green sand molds are transported from the casting mold molding device 29 to a line of the next step.

In addition, pressure value data, casting mold strength data associated with pressure values, casting mold strength calculation results, and casting mold quality determination results, etc., which are produced during the molding step, are all recorded in the recording unit 22 of the casting mold quality evaluation device 12. Therefore, it is possible to use these numerical values to monitor the operational state of the casting mold molding device 29 and these numerical values are useful in quality control, maintenance, and troubleshooting of the casting mold molding device 29. Furthermore, using these numerical values can lead to early detection of defect causes such as: sand spillage, burn-in of a casting, and mold drop which occur due to filling defects; and swelling of a green sand mold due to molten metal pressure after pouring.

Further, in the present embodiment, the green sand mold molding sensors 10A, 10B, 10C, 10D and 10E, 10F, 10G, 10H are embedded in the four corners of the upper and lower surfaces of the plate 2 near the cope 31 and the drag 32. However, even if the number of green sand mold molding sensors embedded in the plate 2 is small, it is possible to calculate the relationship between the casting mold strength and the peak value of the pressure of the green sand mold molding sensors. In that case, accuracy is slightly lower in comparison with the case in which green sand mold molding sensors are embedded in four locations, but it is possible to curb costs.

Figure 20:
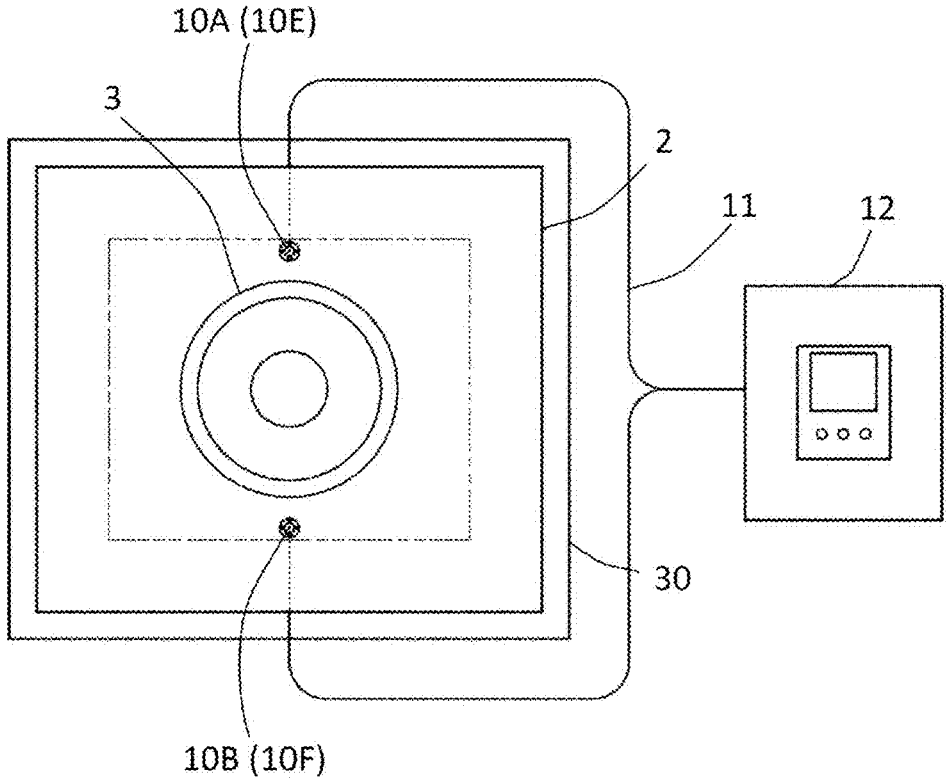
FIG. 20 shows another example of a plate having green sand mold molding sensors embedded therein.
Figure 21:
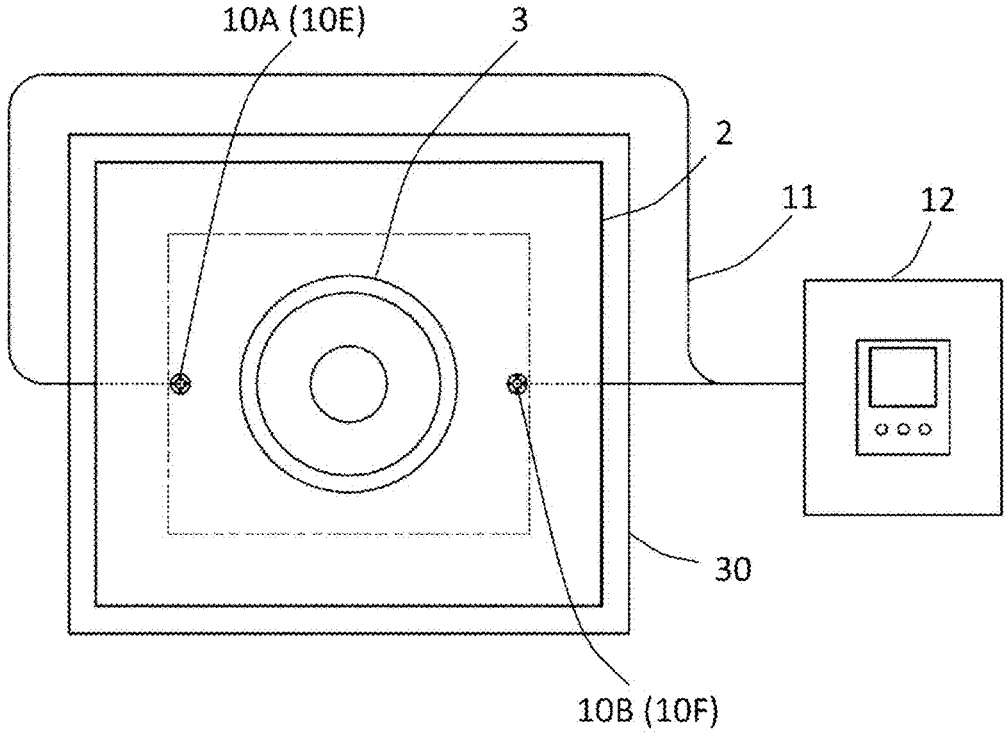
FIG. 21 shows another example of a plate having green sand mold molding sensors embedded therein.

In that case, it is also possible to set two locations 10A, 10B or 10C, 10D on a line between opposing corners of the upper surface of the plate 2 shown in FIG. 18 or to set two locations 10E, 10F or 10G, 10H on a line between opposing corners of the lower surface of the plate 2. FIGS. 20 and 21 show other examples wherein the plate 2 upper surface has green sand mold molding sensors 10A, 10B embedded therein. In FIG. 20, the two green sand mold molding sensors 10A, 10B are embedded near the central section of the long sides of the plate 2. In FIG. 21, the two green sand mold molding sensors 10A, 10B are embedded near the central section of the short sides of the plate 2. It is possible to dispose the molding sensors 10E, 10F in the same state in the lower surface of the plate 2. Due to the arrangement of these molding sensors, it is possible to ascertain a bias in the filling amount, etc., between right and left of the green sand blowing-in ports 35, 35, or in the proximity or distance of the green sand blowing-in ports 35, 35.

(Mode of Plate)

Figure 22:
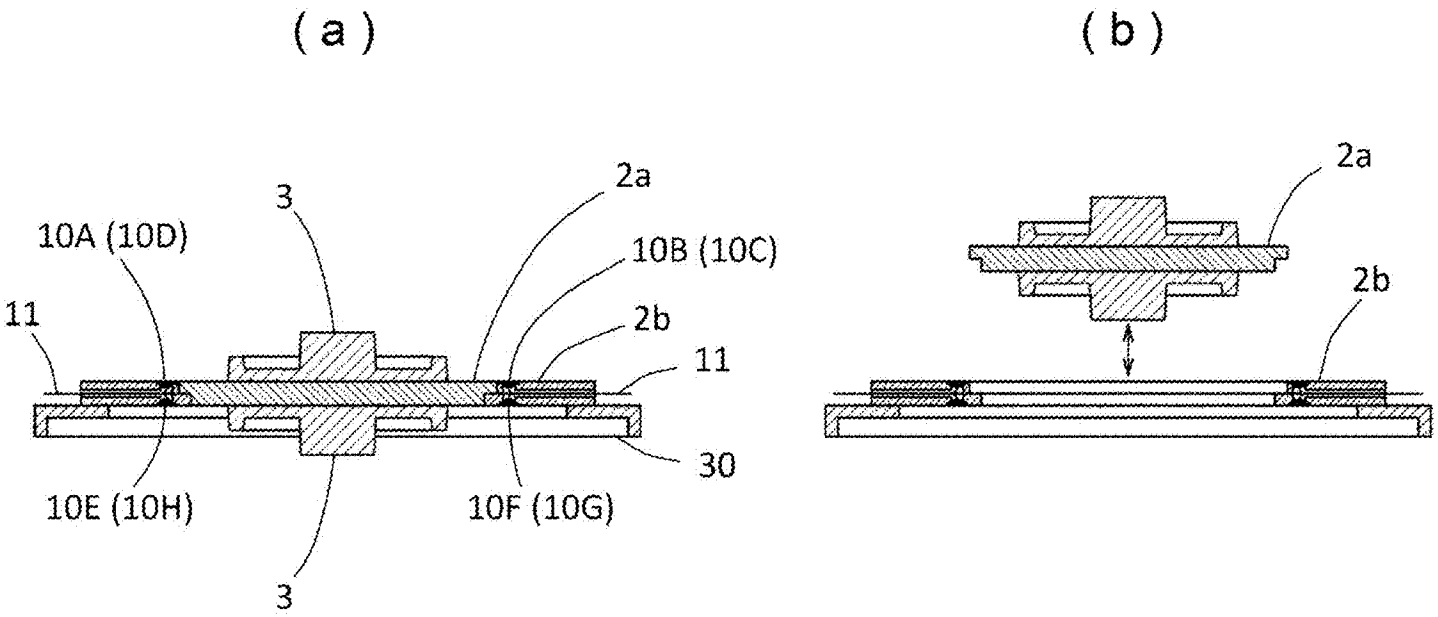
FIG. 22 represents a schematic of a plate structure according to the second embodiment.

FIG. 22 shows a different mode of the plate 2 wherein the model 3 is attached to the upper and lower surfaces thereof. FIG. 22(*a*) shows a plate 2*a* and a plate 2*b* which are placed on the shuttle dolly 30. In other words, the plate 2 is divided into a central plate 2*a* and a peripheral plate 2*b*. The central plate 2*a* and the peripheral plate 2*b* are fixed by bolts (not shown).

The model 3 is attached to upper and lower surfaces of the central plate 2*a*. Further, the green sand mold molding sensors 10A, 10B, 10C, 10D are embedded in the upper surface of the peripheral plate 2*b* and the green sand mold molding sensors 10E, 10F, 10G, 10H are embedded in the lower surface of the peripheral plate 2*b*. The shapes of the central plate 2*a* and the peripheral plate 2*b* are configured while taking into consideration the shape of the model for molding in the casting mold molding device 29 and the positions of the green sand mold molding sensors mentioned above. The shapes of the alignment sections of the central plate 2*a* and the peripheral plate 2*b* are configured so as to share a common shape, and when a model for molding in the casting mold molding device 29 is to be changed, the central plate 2*a* which has the models 3, 3 attached thereto only needs to be replaced.

FIG. 22(*b*) shows a state wherein the central plate 2*a* is detached. By loosening the bolts (not shown) and removing only the central plate 2*a*, which has the models attached thereto, and attaching a central plate having a different model attached thereto, it is possible to easily exchange models without affecting the green sand mold molding sensors.

Thus, according to the green sand mold molding sensor of the second embodiment, in order to determine the quality of a molded casting (casting mold strength), it is possible to measure, during molding of a green sand mold, a pressure value (peak pressure) applied to a parting plane which is a joining section between the upper mold comprising green sand mold sand formed inside the cope 4 and the lower mold comprising green sand mold sand formed inside the drag 5.

(Modifications)

In the first and second embodiments, after determining the relationship between the casting mold strength and the pressure value (peak pressure) from the measured casting mold strength and the pressure value (peak pressure) measured by the green sand mold molding sensors 10A, 10B, 10C, 10D (and 10E, 10F, 10G, 10H), the casting mold quality evaluation device 12 separately calculates the casting mold strength from the pressure value (peak pressure) measured by the green sand mold molding sensors 10A, 10B, 10C, 10D (and 10E, 10F, 10G, 10H). In addition, the quality of a molded green sand mold is determined from the pre-set threshold value of the casting mold strength and the calculated casting mold strength.

Additionally, by feeding back results determined by the casting mold quality evaluation device 12 to a kneading machine, it is possible to accurately control the amount of water injected into the kneading machine. For example, if the pressure value (peak pressure) measured by the green sand mold molding sensors 10A, 10B, 10C, 10D (and 10E, 10F, 10G, 10H) is extremely low and as a result thereof the casting mold strength is extremely low, the casting mold quality evaluation device 12 determines that the reason therefor is because sand was not filled evenly inside the casting mold and that the cause thereof is that the CB value of the green sand is high, and by providing an instruction to the kneading machine to reduce the amount of water injected, it is possible to resolve the filling defect of the green sand.

Furthermore, by feeding back, to the kneading machine, results determined by the casting mold quality evaluation device 12 and results obtained by a green sand automatic measurement system, or the like, measuring and evaluating the compressive strength of the green sand, it is also possible to control the amount of additives, water, etc., loaded into the kneading machine. For example, it is possible to perform an evaluation of the flowability, etc., of the green sand from: properties of the green sand measured by the green sand automatic measurement system such as the compressive strength, permeability, compactability value, water content value, etc. of the green sand; the pressure value (peak pressure) measured by the green sand mold molding sensors 10A, 10B, 10C, 10D (and 10E, 10F, 10G, 10H); and the distribution thereof. Further, by changing the amount of additives, water content, etc., loaded during kneading, it is possible to resolve casting mold defects.

Furthermore, in the first and second embodiments, the casting mold quality evaluation device 12 converts the pressure value (peak pressure) measured by the green sand mold molding sensors 10A, 10B, 10C, 10D (and 10E, 10F, 10G, 10H) into a casting mold strength and determines the quality of molded green sand molds based on the converted casting mold strength and the measured casting mold strength. However, since it has been ascertained that there is a correlative relationship between the pressure value (peak pressure) and the casting mold strength, it is also possible to determine the quality of a green sand mold directly from the pressure value (peak pressure) without converting to the casting mold strength. The first and second embodiments mentioned above are examples in which two or more pressure sensors are provided to the plate. However, in the present invention, a configuration in which one pressure sensor is provided to the plate is also possible. In that case, it is desirable that the position at which the pressure sensor is attached is near the model of the plate. Further, in such cases when there is one pressure sensor, the output of the one pressure sensor also indicates a value related to the casting mold strength at a specific position of the casting mold. Therefore, accuracy decreases but it is possible to use this value to perform an evaluation of the casting mold quality.

Various embodiments of the present invention are described above, but the above descriptions do not limit the present invention and various modifications may be considered, including deletion, addition, and replacement of constituent elements within the technical scope of the present invention.

REFERENCE SIGNS LIST

1 Casting mold molding device (frame casting mold molding)
2 Plate
2*a* Central plate
2*b* Peripheral plate
3 Model
4 Carrier
5 Metal frame
6 Filling frame
7 Squeeze head
8 Squeeze board
9 Table
10A-10H Green sand mold molding sensor
11 Wiring
12 Casting mold quality evaluation device
13 Liner
14 Bolt
15, 15' Receiving unit
16, 16' Amplification unit
17 Input unit
18 Casting mold strength calculation unit
19 Casting mold quality determination unit
20 Display unit
21 Transmission unit
22 Recording unit
23 Patlite
24 Pressure value transmission unit
25 Integrated amplifier-recorder
26 Computer
27 Louvered hopper
28 Louver
29 Casting mold molding machine (flaskless molding machine)
30 Shuttle dolly
31 Cope
32 Drag
33 Upper squeeze board
34 Lower squeeze board
35 Green sand blowing-in port
36 Sand tank

The invention claimed is:

1. A casting mold molding machine comprising a frame-shaped carrier, a green sand mold molding sensor comprising a pressure sensor for evaluating moldability of a green sand mold molded by the casting mold molding machine, a plate that is placed inside the frame-shaped carrier, and a model attached to the plate, wherein a plurality of the pressure sensors are embedded in the plate, a pressure-receiving surface of the plurality of the pressure sensors and a surface of the plate are in a flush state, the plate is separated into a central plate having the model attached thereto and a peripheral plate in which the pressure sensors are embedded, the frame-shaped carrier holds the peripheral plate and the central plate inside the frame-shape, the peripheral plate includes a peripheral portion in which the pressure sensors are embedded and an opening portion that is surrounded by the peripheral portion, and is provided with a stepped surface on an inner periphery thereof, and the central plate is provided with a stepped surface corresponding to the stepped surface of the opening portion on an outer periphery thereof, and is fixed inside the opening portion by a bolt so as to be attachable and detachable, wherein the peripheral plate is rectangular, each of the pressure sensors is embedded in one of the four corners of the peripheral plate, and all of the pressure sensors are disposed at a same height on the peripheral plate.

2. The casting mold molding machine according to claim 1, wherein the plate having the model attached thereto is a member that constitutes a part of a boundary of a molding space defined by the plate and a metal flask during green sand mold molding by the casting mold molding machine.

3. The casting mold molding machine according to claim 1, wherein the pressure sensor is embedded between a wall of a metal flask and the model in the plate at the time of green sand mold molding.

4. The casting mold molding machine according to claim 1, wherein the casting mold molding machine is a flask molding machine and the plate is placed on a carrier.

5. The casting mold molding machine according to claim 1, wherein the casting mold molding machine is a flaskless molding machine and the model is attached to both surfaces of the plate.

6. The casting mold molding machine according to claim 5, wherein the casting mold molding machine is a flaskless molding machine and the plate is placed on a shuttle dolly.

7. The casting mold molding machine according to claim 1, wherein the pressure sensor is fixed to the plate by a screwing means.

8. The casting mold molding machine according to claim 1, wherein the pressure sensor is a fluid sensor.

9. The casting mold molding machine according to claim 1, wherein the pressure sensor has a pressure-receiving surface that is 5-30 mm in diameter.

* * * * *